US009762002B1

(12) United States Patent
Matsumoto et al.

(10) Patent No.: US 9,762,002 B1
(45) Date of Patent: Sep. 12, 2017

(54) CONNECTOR

(71) Applicant: Yazaki Corporation, Tokyo (JP)

(72) Inventors: Yusuke Matsumoto, Shizuoka (JP); Nobuyuki Sakamoto, Shizuoka (JP); Akihiro Tsuruta, Shizuoka (JP); Nobuyuki Mukoujima, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/453,054

(22) Filed: Mar. 8, 2017

(30) Foreign Application Priority Data

Mar. 9, 2016 (JP) ..... 2016-045686

(51) Int. Cl.
*H01R 13/641* (2006.01)
*H01R 13/627* (2006.01)

(52) U.S. Cl.
CPC ..... *H01R 13/641* (2013.01); *H01R 13/6271* (2013.01)

(58) Field of Classification Search
CPC ..... H01R 13/641
See application file for complete search history.

(56) References Cited

U.S. PATENT DOCUMENTS 6,065,991 A * 5/2000 Fukuda ..... H01R 13/641 439/352
2007/0099496 A1* 5/2007 Shigeta ..... H01R 13/6271 439/557
2009/0203248 A1* 8/2009 Matsumura ..... H01R 13/631 439/357
2013/0210266 A1* 8/2013 Osada ..... H01R 13/6272 439/378
2014/0314477 A1* 10/2014 Hamai ..... H01R 13/4362 403/364
2016/0204543 A1* 7/2016 Kanda ..... H01R 13/5829 439/470
2017/0125949 A1* 5/2017 Saur ..... H01R 13/641

FOREIGN PATENT DOCUMENTS

JP 2003-274532 A 9/2003

* cited by examiner

*Primary Examiner* — James Harvey
(74) *Attorney, Agent, or Firm* — Sughrue Mion, PLLC

(57) ABSTRACT

A connector includes a female housing, an engagement detection member, and a cover member. The female housing is provided with a terminal connected to a counterpart terminal of a counterpart connector and is capable of being engaged with the counterpart connector. The engagement detection member is assembled with the female housing in a movable manner from an initial position to an engagement assurance position in a state where the counterpart connector and the female housing are completely engaged with each other. The cover member is assembled with the engagement detection member through a locking unit locked with the engagement detection member. The locking unit is provided inside an outer shape line of the engagement detection member when viewed in a direction of relative movement between the female housing and the engagement detection member.

3 Claims, 16 Drawing Sheets

CONNECTOR

CROSS-REFERENCE TO RELATED APPLICATION(S)

The present application claims priority to and incorporates by reference the entire contents of Japanese Patent Application No. 2016-045686 filed in Japan on Mar. 9, 2016.

BACKGROUND OF THE INVENTION

1. Field of the Invention

The present invention relates to a connector.

2. Description of the Related Art

As a conventional connector that is applied to a wire harness and the like, for example, Japanese Patent Application Laid-open No. 2003-274532 discloses a protector attached to an incomplete engagement detection connector that includes a connector housing and an engagement detection member. The connector housing houses a connection terminal in a terminal housing chamber, and has a packing attached to an end part of an electric wire connected to the connection terminal inserted in a rear end of the terminal housing chamber. The engagement detection member is slidably attached to the outer periphery of the connector housing along a mutual engagement direction between male and female connectors, and detects an incomplete engagement state of the male and female connectors by availability of slide movement.

The protector disclosed in Japanese Patent Application Laid-open No. 2003-274532 functions as a cover member that is assembled with an engagement detection member and covers an end part of a corrugated tube serving as an exterior member of an electric wire connected to the incomplete engagement detection connector, but size of the outer shape may be increased depending on, for example, an assembling structure of the engagement detection member and the protector, and there is room for further improvement in this point.

SUMMARY OF THE INVENTION

In view of the foregoing, an object of the present invention is to provide a connector capable of reducing an increase in size.

In order to achieve the above mentioned object, a connector according to one aspect of the present invention includes a housing that is provided with a terminal connected to a counterpart terminal of a counterpart connector and is capable of being engaged with the counterpart connector; an engagement detection member that is assembled with the housing in a movable manner from an initial position to an engagement assurance position in a state where the counterpart connector and the housing are completely engaged with each other; and a cover member that is assembled with the engagement detection member through a locking unit locked with the engagement detection member, wherein the locking unit is provided inside an outer shape line of the engagement detection member when viewed in a direction of relative movement between the housing and the engagement detection member.

According to another aspect of the present invention, in the connector, the locking unit may include a locking claw that is locked with the engagement detection member and is bent when being locked with the engagement detection member, the cover member may include an evacuation space that accommodates the locking claw when the locking claw is bent, and the housing may include a control unit that is disposed outside the evacuation space in a state where the engagement detection member is disposed at the initial position and is disposed inside the evacuation space in a state where the engagement detection member is disposed at the engagement assurance position so as to control bending of the locking claw.

According to still another aspect of the present invention, in the connector, the control unit may contact the locking claw in a state where the locking claw is bent and is evacuated to the evacuation space so as to prevent the engagement detection member from moving from the initial position to the engagement assurance position.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

An embodiment according to the present invention will now be described with reference to the accompanying drawings. It should be noted that this embodiment is not intended to limit the invention. Components in the embodiment include components that can be replaced and are facilitated by the skilled person or substantially like components.

Embodiment

Figure 1:
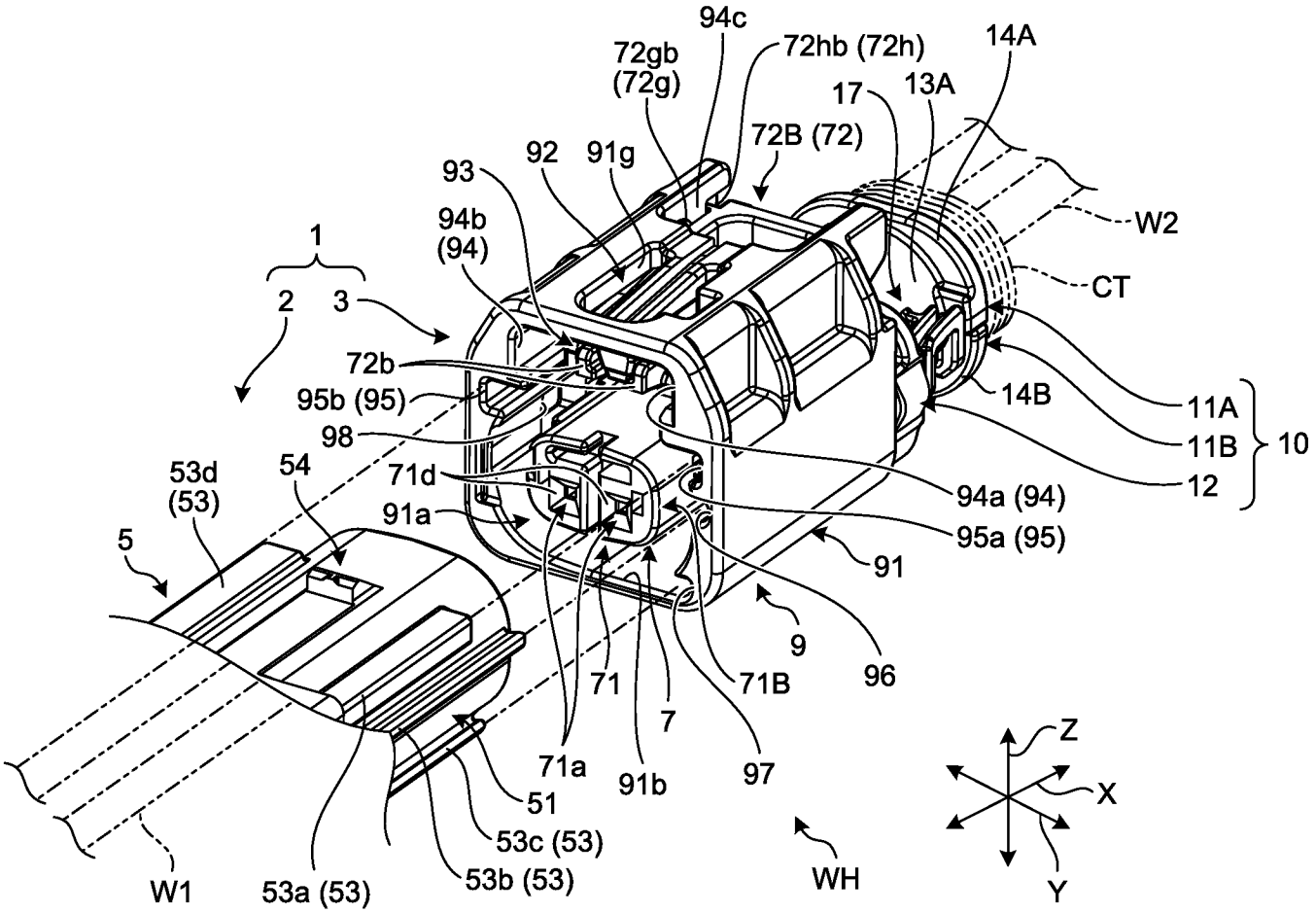
FIG. 1 is an exploded perspective view illustrating a schematic configuration of a connector mechanism in accordance with an embodiment of the present invention.
Figure 12:
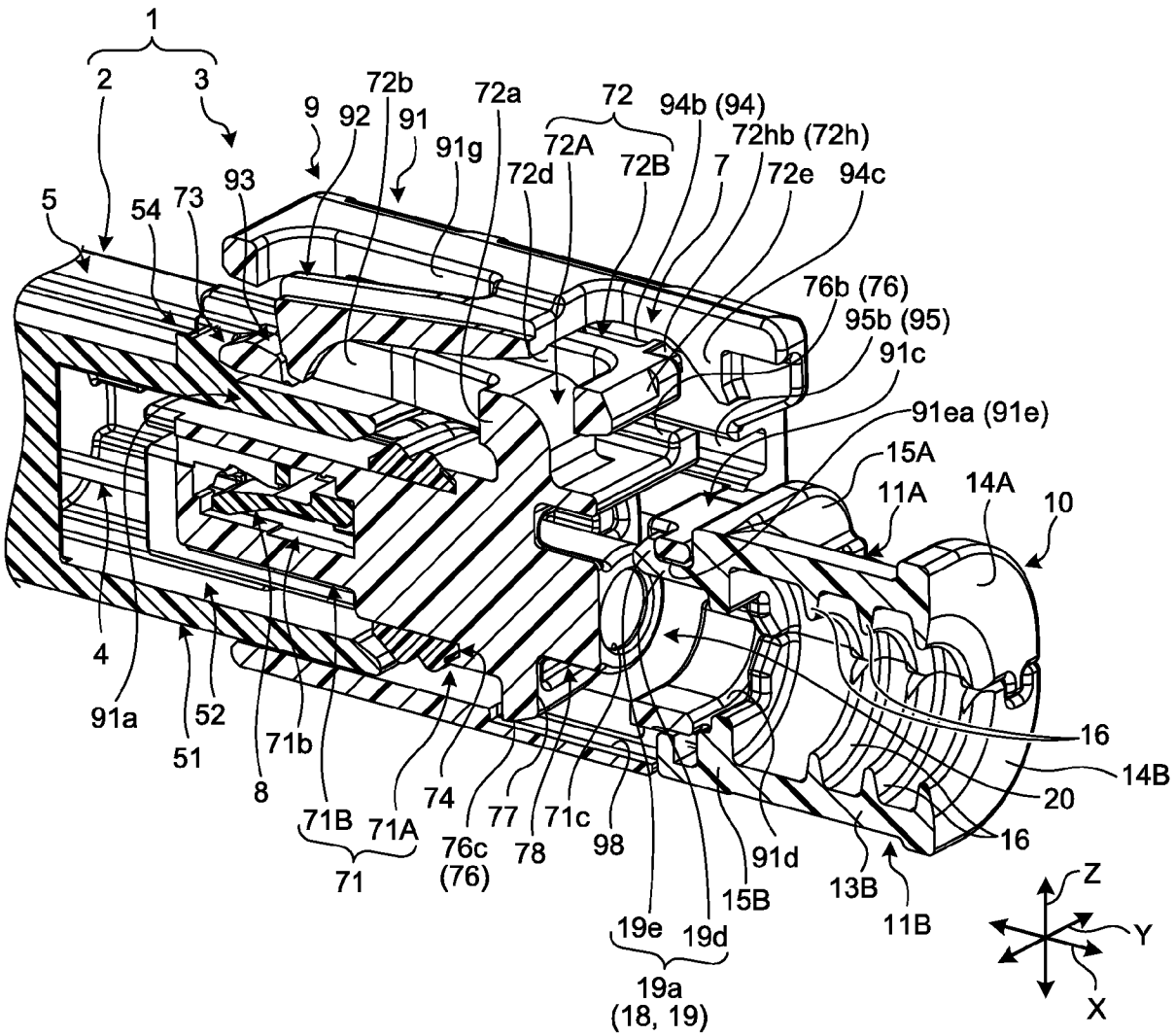
FIG. 12 is a partially cross-sectional perspective view illustrating operation of the connector mechanism in accordance with the embodiment.
Figure 13:
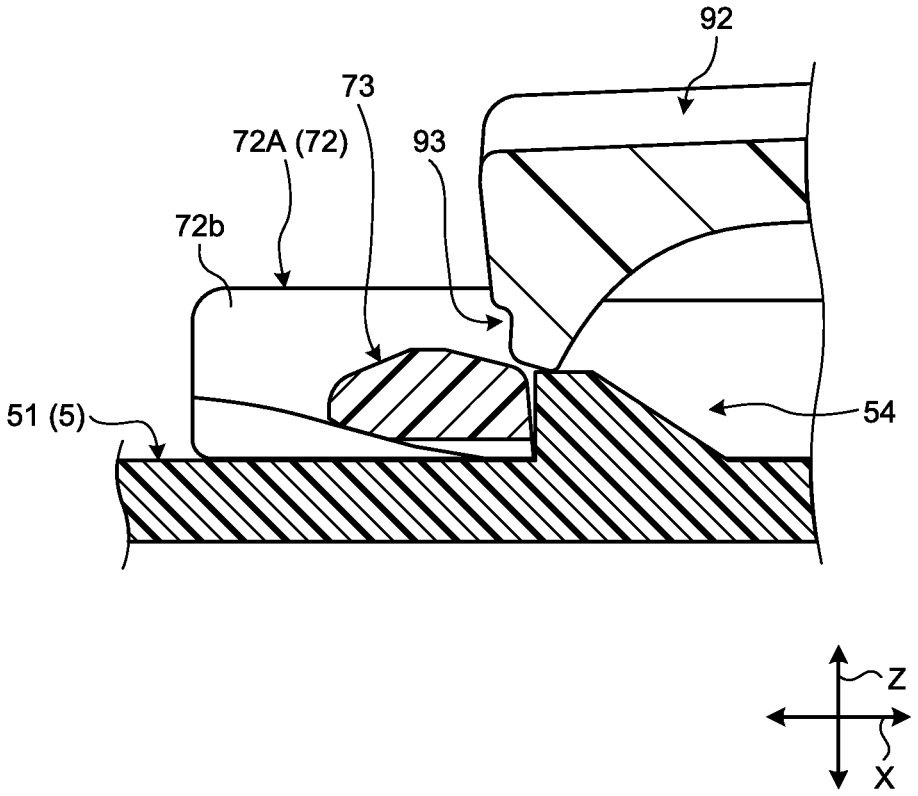
FIG. 13 is a partially cross-sectional view illustrating operation of the connector mechanism in accordance with the embodiment.
Figure 14:
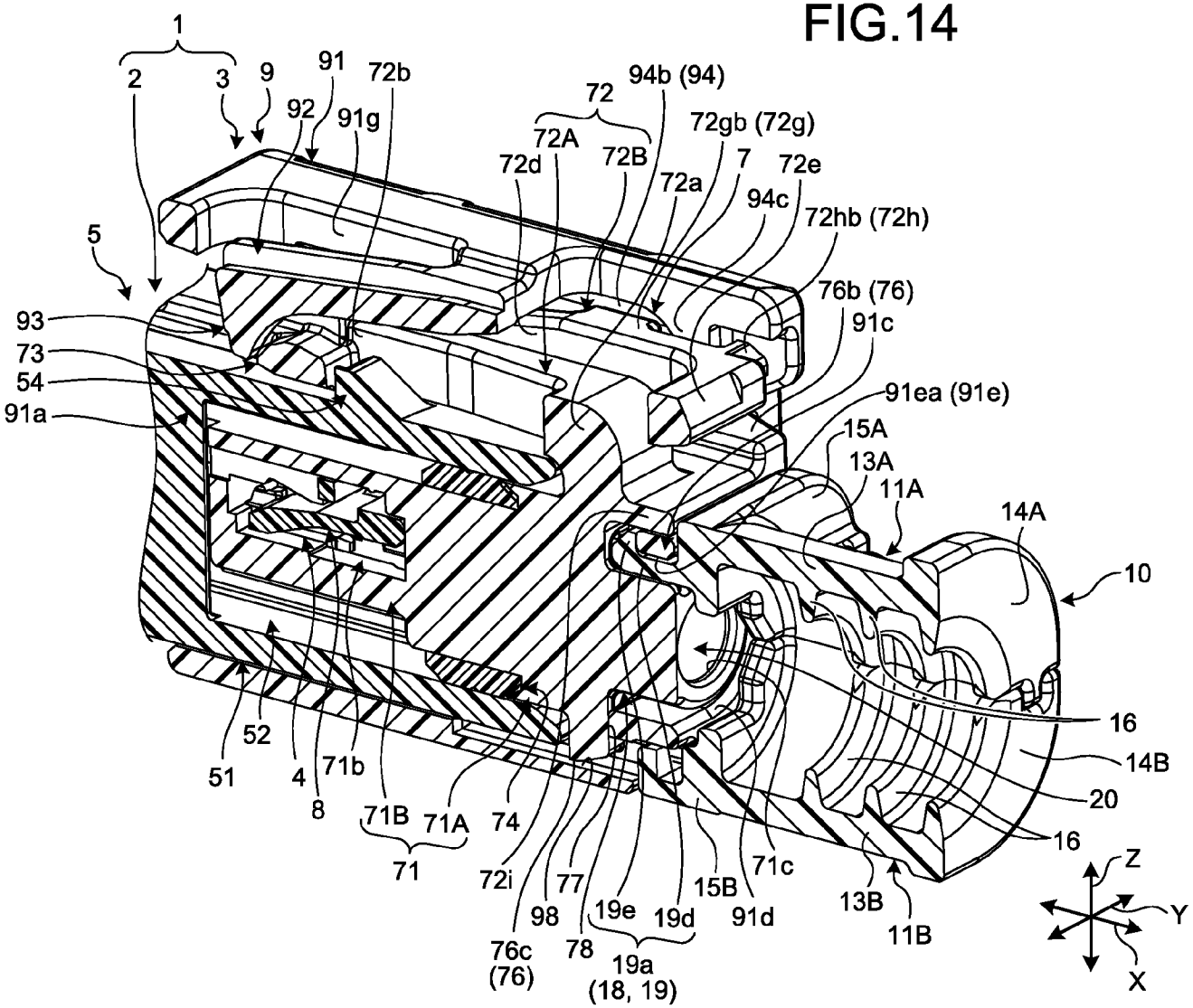
FIG. 14 is a partially cross-sectional perspective view illustrating operation of the connector mechanism in accordance with the embodiment.

FIG. 1 described below illustrates a state where each component forming a female connector is assembled, and FIGS. 2 and 3 each illustrate a state where each component forming the female connector is disassembled. FIGS. 1 and 4 illustrate parts of electric wires connected to terminals by two-dot chain lines, and other drawings omit an illustration of the electric wires. Similarly, FIG. 4 illustrates a female terminal of the female connector by a two-dot chain line, and other drawings omit an illustration of the female terminal. Each drawing partially illustrates a part of a male housing including a hood unit. FIG. 12 illustrates a state where a connector position assurance (CPA) member is disposed at an initial position, FIG. 13 illustrates a state where the male housing and a female housing are completely engaged with each other, and FIG. 14 illustrates a state where the CPA member is disposed at an engagement assurance position.

Figure 2:
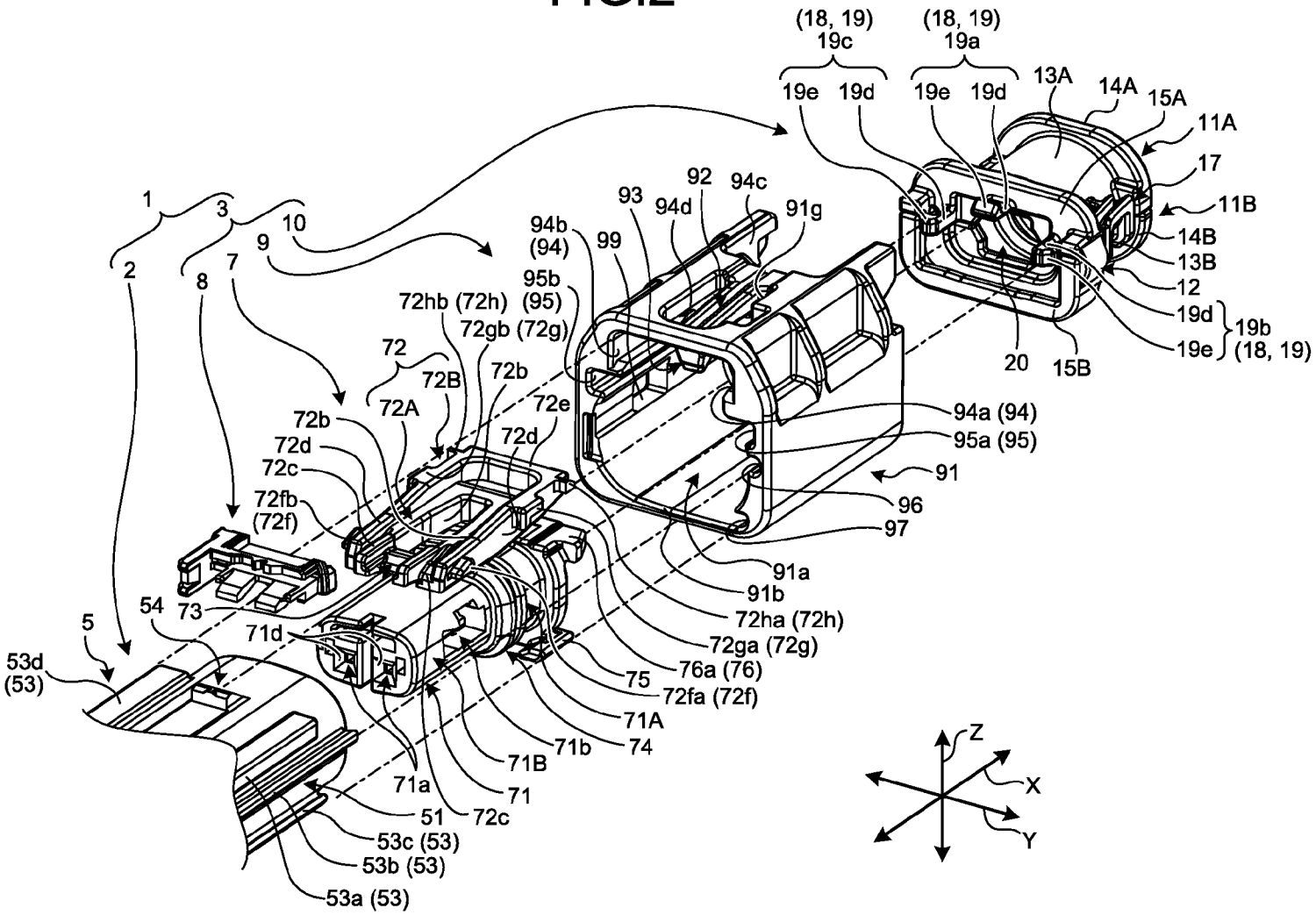
FIG. 2 is an exploded perspective view illustrating a schematic configuration of the connector mechanism in accordance with the embodiment.
Figure 3:
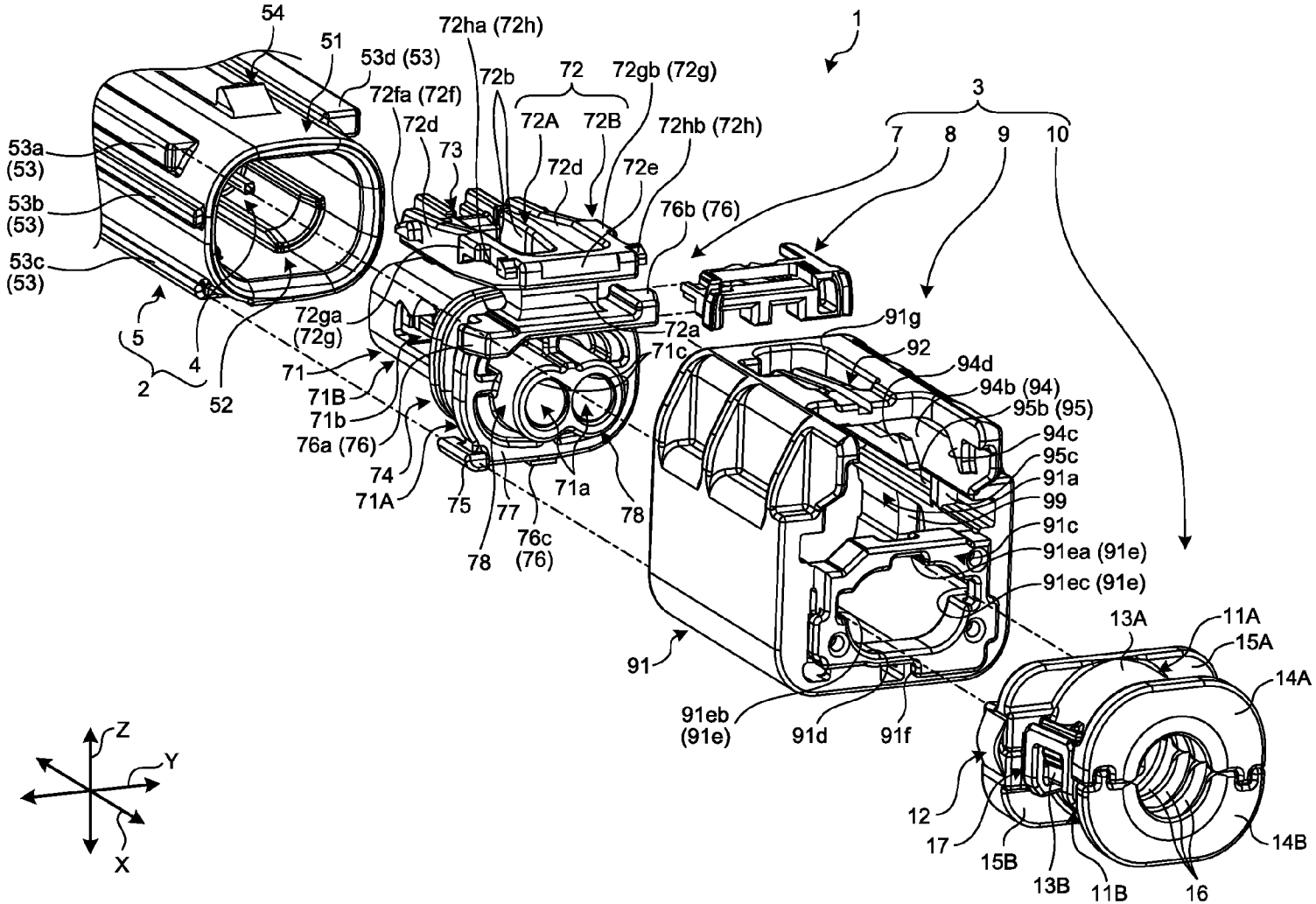
FIG. 3 is an exploded perspective view illustrating a schematic configuration of the connector mechanism in accordance with the embodiment.
Figure 4:
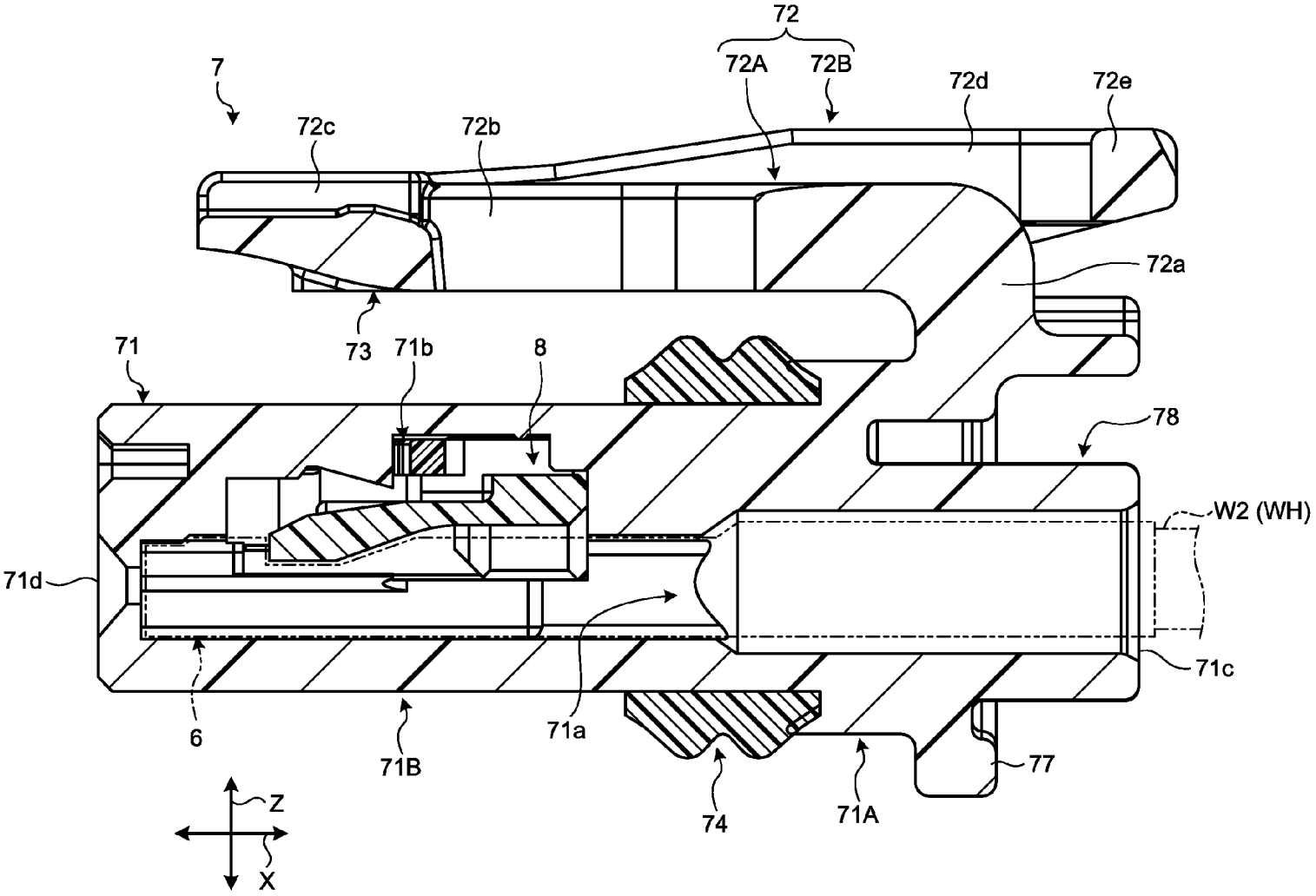
FIG. 4 is a cross-sectional view of a female housing included in a female connector in accordance with the embodiment along an axial direction and a height direction.

A connector mechanism 1 in FIGS. 1, 2, 3, and the like is applied to a wire harness WH and the like used for an automobile and the like. The connector mechanism 1 is a connection mechanism for an electric wire-to-electric wire connection that connects electric wires W1 and W2 forming the wire harness WH to each other. Each of the electric wires W1 and W2 includes, for example, a conductor (core wire) obtained by twisting a plurality of conductive metal element wires and an insulating covering unit that covers the outside of the conductor. This connector mechanism 1 includes a male connector 2 as a counterpart connector and a female connector 3 as a connector. By engaging the male connector 2 with the female connector 3 and making a connector connection, a male terminal 4 included in the male connector 2 and a female terminal 6 included in the female connector 3 are electrically connected to each other so as to form an electric connection part between the male terminal 4 and the female terminal 6.

Hereinafter, out of mutually crossing first, second, and third directions, the first direction is referred to as "axial direction X", the second direction as "width direction Y", and the third direction as "height direction Z". The axial direction X, the width direction Y, and the height direction Z are orthogonal to one another. The axial direction X is typically a direction along an engagement direction of the male connector 2 and the female connector 3, and, in addition, is a direction along an extension direction of the male terminal 4 included in the male connector 2 and the female terminal 6 included in the female connector 3. The male connector 2 and the female connector 3 are disposed opposed to the axial direction X and are engaged with each other. Hereinafter, each of the directions represents, unless otherwise noted, a direction in a state where each unit is assembled with each other.

The male connector 2 is a male connector connected to an end of the electric wire W1 serving as a first electric wire that forms the wire harness WH as illustrated in FIGS. 1, 2, 3, and the like. The male connector 2 includes the male terminal 4 (see FIG. 3) as a counterpart terminal and a male housing 5 as a counterpart housing provided with the male terminal 4. Hereinafter, in the male connector 2, a female connector 3 side in the axial direction X may be referred to as a front side, and a side opposite to the female connector 3 side may be referred to as a rear side in the axial direction X.

The male terminal 4 is a male terminal metal fitting for a connector, and is connected to an end of the electric wire W1 and is formed of conductive metal as a whole. The male housing 5 is a male connector housing provided with the male terminal 4, and is formed of an insulating synthetic resin material and the like. The male housing 5 includes a hood 51 in which an engagement space 52 is formed. The hood 51 is formed in substantially a long cylindrical shape where an axis line is along the axial direction X, and the engagement space 52 is formed inside the hood 51. The engagement space 52 is a space where a female housing 7 of the female connector 3, which will be described later, is engaged. The male housing 5 holds the male terminal 4 so that the tip of the male terminal 4 (the front side end part in the axial direction X) is exposed in the engagement space 52. The male terminal 4 extends in the axial direction X while held by the male housing 5. In the male terminal 4, for example, an end part on a side opposite to the tip exposed in the engagement space 52 (the rear side end part in the axial direction X) is held in a terminal insertion chamber (may be referred to as a cavity) of a terminal holding unit integrally formed with the hood 51, and the electric wire W1 is connected to the end part. The male terminal 4 is inserted from the rear side in the axial direction X and held in the terminal insertion chamber, and the tip thereof on the front side in the axial direction X is exposed in the engagement space 52 of the hood 51. In the male connector 2, the hood 51 is open on the front side in the axial direction X, and the electric wire W1 extends on the rear side in the axial direction X. The male housing 5 holds a plurality of, in the embodiment, two male terminals 4 (one of the male terminals 4 is not illustrated).

The male connector 2 includes a plurality of projective ribs 53 and a male beak 54 as a counterpart lock on the outer surface of the hood 51. The projective ribs 53 are formed by projecting from the outer surface of the hood 51, and extend in a linear rod shape along the axial direction X. The projective ribs 53 are inserted in a CPA member 9, which will be described later, and is a part held by the CPA member 9. Three projective ribs 53 are provided to the hood 51 on one side in the width direction Y, and one projective rib 53 to the hood 51 on the other side in the width direction Y, in other words, four projective ribs 53 are provided in total. When distinctively, four projective ribs 53 may be referred to as projective ribs 53*a*, 53*b*, 53*c*, and 53*d* for convenience. The projective ribs 53*a*, 53*b*, and 53*c* are provided to one side in the width direction Y, and the projective rib 53*d* is provided to the other side in the width direction Y. The projective ribs 53*a* and 53*d* are each provided to one corner in the height direction Z, the projective rib 53*c* is provided to the other corner in the height direction Z, and the projective rib 53*b* is provided between the projective ribs 53*a* and 53*c* with respect to the height direction Z. The projective ribs 53*a*, 53*b*, 53*c*, and 53*d* slightly differ from one another in shape, but the projective ribs 53*a*, 53*b*, 53*c*, and 53*d* extend in a linear rod shape along the axial direction X in common. The male beak 54 is formed by projecting from the outer surface of the hood 51. One male beak 54 is formed in a claw shape nearly at the center of one of the outer surfaces of the hood 51 along the axial direction X and the width direction Y. The male beak 54 is formed by projecting along the height direction Z. The male beak 54 is a part with which a female lock 73 of the female connector 3, which will be described later, is locked. In the male beak 54, an inclined surface is formed at the end part of the front side in the axial direction X on the male housing 5 so that a projection amount from the outer surface of the male housing 5 is gradually increased from the front side toward the rear side, and a rising locking surface is formed substantially vertically from the outer surface of the male housing 5 at the end part of the rear side in the axial direction X on the male housing 5.

The female connector 3 is a female connector connected to an end of the electric wire W2 serving as a second electric wire that forms the wire harness WH as illustrated in FIGS. 1, 2, 3, 4, and the like. The female connector 3 includes the female terminal 6 (see FIG. 4) as a terminal, the female housing 7 serving as a housing provided with the female terminal 6, a spacer 8 assembled with the female housing 7, the CPA member 9 as an engagement detection member assembled with the female housing 7 in a relatively movable manner along the axial direction X, and a cover member 10 assembled with the CPA member 9. Hereinafter, in the female connector 3, a male connector 2 side in the axial direction X may be referred to as a front side, and a side opposite to the male connector 2 side may be referred to as a rear side in the axial direction X.

The female terminal 6 is a female terminal metal fitting for a connector, and is connected to an end of the electric wire W2 and is formed of conductive metal as a whole. In the female connector 3, the female housing 7 is engaged with the engagement space 52 of the male housing 5, and the female terminal 6 is electrically connected to the male terminal 4 of the male connector 2.

The female housing 7 is a female connector housing provided with the female terminal 6 as illustrated in FIGS. 2, 3, 4, and the like, and is formed of an insulating synthetic resin material and the like. The female housing 7 holds the female terminal 6, and is a member that can be engaged with the engagement space 52 of the male housing 5. The female housing 7 includes a female main body 71 that holds the female terminal 6 and assembles the spacer 8 and the CPA member 9, a female lock arm 72 that extends from the female main body 71, and a female lock 73 as a first lock formed on the female lock arm 72. The female main body 71 is formed in substantially a long columnar shape where an axis line is along the axial direction X. The female lock arm 72 is supported in a cantilever shape at an end part of the female main body 71 on the rear side in the axial direction X, and extends toward the front side along the axial direction X. The female lock 73 is formed at the end part of the female lock arm 72 on the front side in the axial direction X. The female lock arm 72 and the female lock 73 form a lock mechanism for locking the female housing 7 with the male housing 5 of the male connector 2. The female housing 7 is formed by integrating the female main body 71, the female lock arm 72, and the female lock 73 with an insulating synthetic resin material and the like.

The female main body 71 is a part that is engaged with the engagement space 52 of the male housing 5, and includes a terminal insertion chamber 71*a* and a spacer engagement unit 71*b* and each of the units is integrally formed. The female main body 71 holds the female terminal 6 by inserting the female terminal 6 in the terminal insertion chamber 71*a* from the rear side in the axial direction X and inserting the spacer 8 in the spacer engagement unit 71*b* from one side in the width direction Y.

Specifically, the terminal insertion chamber 71*a* is a space in which the female terminal 6 can be inserted along the axial direction X, and that holds the female terminal 6. The terminal insertion chamber 71*a* may be referred to as a cavity. The terminal insertion chamber 71*a* extends inside the female main body 71, and is formed in a hollow shape so as to house the female terminal 6. The terminal insertion chamber 71*a* extends along the axial direction X. The terminal insertion chamber 71*a* is formed as a space having a size and a shape capable of having the female terminal 6 inserted therein depending on an outer shape of the female terminal 6. In the terminal insertion chamber 71*a*, a female terminal insertion aperture 71*c* is formed on the rear side in the axial direction X, and a male terminal insertion aperture 71*d* is formed on the front side in the axial direction X. The female terminal insertion aperture 71*c* is open toward the rear side in the axial direction X with respect to the outside of the female main body 71 as an aperture in which the female terminal 6 is inserted. The male terminal insertion aperture 71*d* is open toward the front side in the axial direction X with respect to the outside of the female main body 71 as an aperture in which the male terminal 4 of the male connector 2 electrically connected to the female terminal 6 is inserted. A plurality of terminal insertion chambers 71*a*, in the embodiment, two terminal insertion chambers 71*a* are provided side by side in the width direction Y depending on the number of a plurality of female terminals 6 provided to the female connector 3. In the female main body 71, the female terminals 6 are inserted in the terminal insertion chambers 71*a* through the female terminal insertion apertures 71*c*.

The spacer engagement unit 71*b* is a space with which the spacer 8 is engaged. The spacer engagement unit 71*b* extends along a direction crossing an extension direction of the terminal insertion chambers 71*a*, in the embodiment, the width direction Y, and is communicated with the terminal insertion chambers 71*a*. The spacer engagement unit 71*b* is communicated with a middle part of each of the terminal insertion chambers 71*a* in the axial direction X, and passes through the female main body 71 along the width direction Y.

The female main body 71 in the embodiment includes, more specifically, a large diameter part 71A and a small diameter part 71B that extend along the axial direction X, and the female main body 71 is formed by integrating the large diameter part 71A and the small diameter part 71B. The large diameter part 71A, and the small diameter part 71B are formed in substantially a long columnar shape where the axis line is along the axial direction X. The large diameter part 71A is disposed at the rear side in the axial direction X and the small diameter part 71B at the front side in the axial direction X, and the large diameter part 71A and the small diameter part 71B are integrally formed adjacent to each other in the axial direction X. A diameter of the large diameter part 71A in a direction orthogonal to the axial direction X is formed larger than that of the small diameter part 71B, in other words, a diameter of the small diameter part 71B in a direction orthogonal to the axial direction X is formed smaller than that of the large diameter part 71A. The large diameter part 71A is a part that is a base end part supporting the female lock arm 72 in a cantilever shape. By contrast, in the female main body 71, the small diameter part 71B is a part that is engaged with the engagement space 52 of the male housing 5, and is formed in a size and a shape capable of being engaged with the engagement space 52. The large diameter part 71A is exposed from the engagement space 52 of the male housing 5 while the small diameter part 71B is engaged with the engagement space 52. In the female main body 71, a packing 74 for water cut-off formed in an annular shape is attached to a step part between the large diameter part 71A and the small diameter part 71B. In the female main body 71, the terminal insertion chambers 71*a* extend across the large diameter part 71A and the small diameter part 71B along the axial direction X. In the female main body 71, the spacer engagement unit 71*b* is formed on the small diameter part 71B.

The female main body 71 also includes a projective rib 75 and a plurality of control projections 76 on the outer surface of the large diameter part 71A. The projective rib 75 is formed by projecting from the outer surface at the end part of the large diameter part 71A on the rear side in the axial direction X, and extends in a linear rod shape along the axial direction X. The projective rib 75 is inserted in the CPA member 9, and is a part held by the CPA member 9. The projective rib 75 is provided to one corner of the large diameter part 71A. The projective rib 75 is provided to one corner (corner of a position opposed to the projective rib 53*c* with respect to the axial direction X) out of two corners on a side opposite to the side where the female lock arm 72 is provided in the height direction Z. The control projections 76 are formed by projecting from the outer surface at the end part of large diameter part 71A on the rear side in the axial direction X. The control projections 76 are parts that are inserted in the CPA member 9 and contact a predetermined part (control projection 95*c* of the CPA member 9, which will be described later) so as to control relative movement between the female housing 7 and the CPA member 9 along the axial direction X at a predetermined position (initial position of the CPA member 9, which will be described later). One control projection 76 is formed in a claw shape by projecting along the width direction Y from the position on one side in the height direction Z (side to which the female lock arm 72 is provided) at each of both end parts of the large diameter part 71A in the width direction Y, and one control projection 76 is formed in a claw shape by projecting along the height direction Z from an surface of the large diameter part 71A on the other side in the height direction Z (side to which the projective rib 75 is provided), in other words, three control projections 76 are provided in total. When described distinctively, three control projections 76 may be referred to as control projections 76*a*, 76*b*, and 76*c* for convenience. The control projections 76*a* and 76*b* are formed at positions opposed to each other with respect to the width direction Y. The control projection 76*a* is formed at a position opposed to the projective rib 53*a* with respect to the axial direction X, and the control projection 76*b* at a position opposed to the projective rib 53*d* with respect to the axial direction X. The control projections 76*c* is formed nearly at the center in the width direction Y on a surface of the large diameter part 71A on the other side in the height direction Z (side opposite to the side to which the female lock arm 72 is provided).

In the female housing 7 in the embodiment, a control end surface 77 and a cylindrical unit 78 are formed on an end surface of the large diameter part 71A of the female main body 71 on the rear side in the axial direction X. The control end surface 77 is a part that contacts a predetermined part of the CPA member 9 (control wall 91*c* of the CPA member 9, which will be described later) so as to control relative movement between the female housing 7 and the CPA member 9 along the axial direction X at a predetermined position (engagement assurance position of the CPA member 9, which will be described later). The control end surface 77 is formed in an annular shape. The cylindrical unit 78 is formed by projecting in a cylindrical shape inside the control end surface 77 formed in an annular shape along the axial direction X. In the cylindrical unit 78, a space on an inner periphery surface side forms a part of the terminal insertion chamber 71*a*, and an aperture on the rear side in the axial direction X forms the female terminal insertion aperture 71*c*. A plurality of cylindrical units 78, in the embodiment, two cylindrical units 78 are provided side by side in the width direction Y depending on the number of the terminal insertion chambers 71*a*, and are connected to and integrated with each other.

The female lock arm 72 is a part that has flexibility and is supported in a cantilever shape with respect to the large diameter part 71A in the female main body 71. The female lock arm 72 includes a first arm 72A and a second arm 72B, and the female lock arm 72 is formed by integrating the first arm 72A and the second arm 72B.

The first arm 72A is supported by the end part of the female main body 71 on the rear side in the axial direction X, in the embodiment, by the large diameter part 71A, and is formed by extending in a cantilever shape that has flexibility toward the front side along the axial direction X. The first arm 72A includes a base end part 72*a* that projects from the large diameter part 71A of the female main body 71, and a pair of cantilever beam-shaped units 72*b* that extend from the base end part 72*a*, and the first arm 72A is formed in a lever shape as a whole. The base end part 72*a* is formed by projecting from the large diameter part 71A of the female main body 71 along the height direction Z. The cantilever beam-shaped units 72*b* extend from the tip of the base end part 72*a* in the height direction Z toward the front side along the axial direction X. The cantilever beam-shaped units 72*b* are formed opposed to each other with respect to the width direction Y and in parallel with each other along the axial direction X. The cantilever beam-shaped units 72*b* support the female lock 73 at the end part on a side opposite to the base end part 72*a*, in other words, at the end part on the front side in the axial direction X. The cantilever beam-shaped units 72*b* sandwich the female lock 73 with respect to the width direction Y so as to support the female lock 73. In other words, the female lock 73 is formed in a beam shape along the width direction Y between the cantilever beam-shaped units 72*b* with respect to the width direction Y, and connects the cantilever beam-shaped units 72*b* to each other. The first arm 72A is supported in a cantilever shape capable of elastically deforming at the base end part 72*a* on the rear side in the axial direction X, and has a free end on a female lock 73 side on the front side in the axial direction X. In this manner, the first arm 72A is supported in an elastically deformable manner along the height direction Z with respect to the large diameter part 71A of the female main body 71.

The second arm 72B is supported by the end part of the first arm 72A on the front side in the axial direction X, in the embodiment, by the end part of the cantilever beam-shaped units 72*b* on the front side in the axial direction X, and is formed by extending in a cantilever shape that has flexibility toward the rear side along the axial direction X. The second arm 72B includes a pair of base end parts 72*c* that each project from the cantilever beam-shaped units 72*b* of the first arm 72A, a pair of cantilever beam-shaped units 72*d* that each extend from the base end parts 72*c*, and a connecting unit 72*e* that connects the cantilever beam-shaped units 72*d* to each other. The second arm 72B is formed in a lever shape as a whole. The base end parts 72*c* are formed by each projecting from the cantilever beam-shaped units 72*b* toward a side opposite to each other along the width direction Y, in other words, a side opposite to the female lock 73. The cantilever beam-shaped units 72*d* each extend from the tip of the base end parts 72*c* in the width direction Y toward the rear side along the axial direction X. The cantilever beam-shaped units 72*d* are formed opposed to each other with respect to the width direction Y and in parallel with each other along the axial direction X. More specifically, the cantilever beam-shaped units 72*d* are formed in parallel along the axial direction X by sandwiching the cantilever beam-shaped units 72*b* therebetween with respect to the width direction Y. The connecting unit 72*e* connects the end parts on a side opposite to the base end parts 72*c* of the cantilever beam-shaped units 72*d*, in other words, the end parts on the rear side in the axial direction X. Stated differently, the connecting unit 72*e* is formed in a beam shape along the width direction Y between the cantilever beam-shaped units 72*d* with respect to the width direction Y, and connects the cantilever beam-shaped units 72*d* to each other. The second arm 72B is supported in a cantilever shape capable of elastically deforming at the base end parts 72*c* on the front side in the axial direction X, and has a free end on a connecting unit 72*e* side on the rear side in the axial direction X. In this manner, the second arm 72B is supported in an elastically deformable manner along the height direction Z with respect to the first arm 72A. The cantilever beam-shaped units 72*d* are each provided with a plurality of projective ribs 72*f*, 72*g*, and 72*h* on a surface of the outside in the width direction Y, in other words, on a surface on a side opposite to the surface opposed to the cantilever beam-shaped units 72*b*. The projective ribs 72*f*, 72*g*, and 72*h* are each formed by projecting from the cantilever beam-shaped units 72*d* in the width direction Y. The projective ribs 72*f*, 72*g*, and 72*h* are each formed at intervals along the axial direction X on the cantilever beam-shaped units 72*d*. The projective ribs 72*f*, 72*g*, and 72*h* are formed from the front side toward the rear side in the axial direction X in the order of the projective ribs 72*f*, 72*g*, and 72*h*. When described distinctively, two projective ribs 72*f* may be referred to as projective ribs 72*fa* and 72*fb* for convenience. Similarly, when described distinctively, two projective ribs 72*g* may be referred to as projective ribs 72*ga* and 72*gb* for convenience, and when described distinctively, two projective ribs 72*h* may be referred to as projective ribs 72*ha* and 72*hb* for convenience.

The female lock 73 is a part that gets over the male beak 54 and can be locked with the male beak 54 in a state where the small diameter part 71B of the female main body 71 of the female housing 7 is engaged with the engagement space 52 of the male housing 5 (hereinafter, may be simply referred to as "in a state where the male housing 5 is engaged with the female housing 7"). The female lock 73 is supported between the end parts of the cantilever beam-shaped units 72*b* on the front side in the axial direction X as described above. The female lock 73 is formed in a beam shape along the width direction Y, and connects the cantilever beam-shaped units 72*b* to each other.

The spacer 8 assembled with the female housing 7 is a member that secures a proper terminal holding force for holding the female terminals 6 in the terminal insertion chambers 71*a* as illustrated in FIGS. 2, 3, 4, and the like. The spacer 8 is formed in a size and a shape capable of being engaged with the spacer engagement unit 71*b*, and is attachably/detachably assembled with the spacer engagement unit 71*b* along the width direction Y. The spacer 8 is inserted in the spacer engagement unit 71*b* and is assembled at a predetermined position so as to lock the female terminal 6 inserted and held in each of the terminal insertion chambers 71*a* with a regular position in the terminal insertion chamber 71*a*. The regular position of each of the female terminals 6 in the terminal insertion chamber 71*a* is a position that secures a proper electric connection between the female terminals 6 and the male terminal 4.

Figure 5:
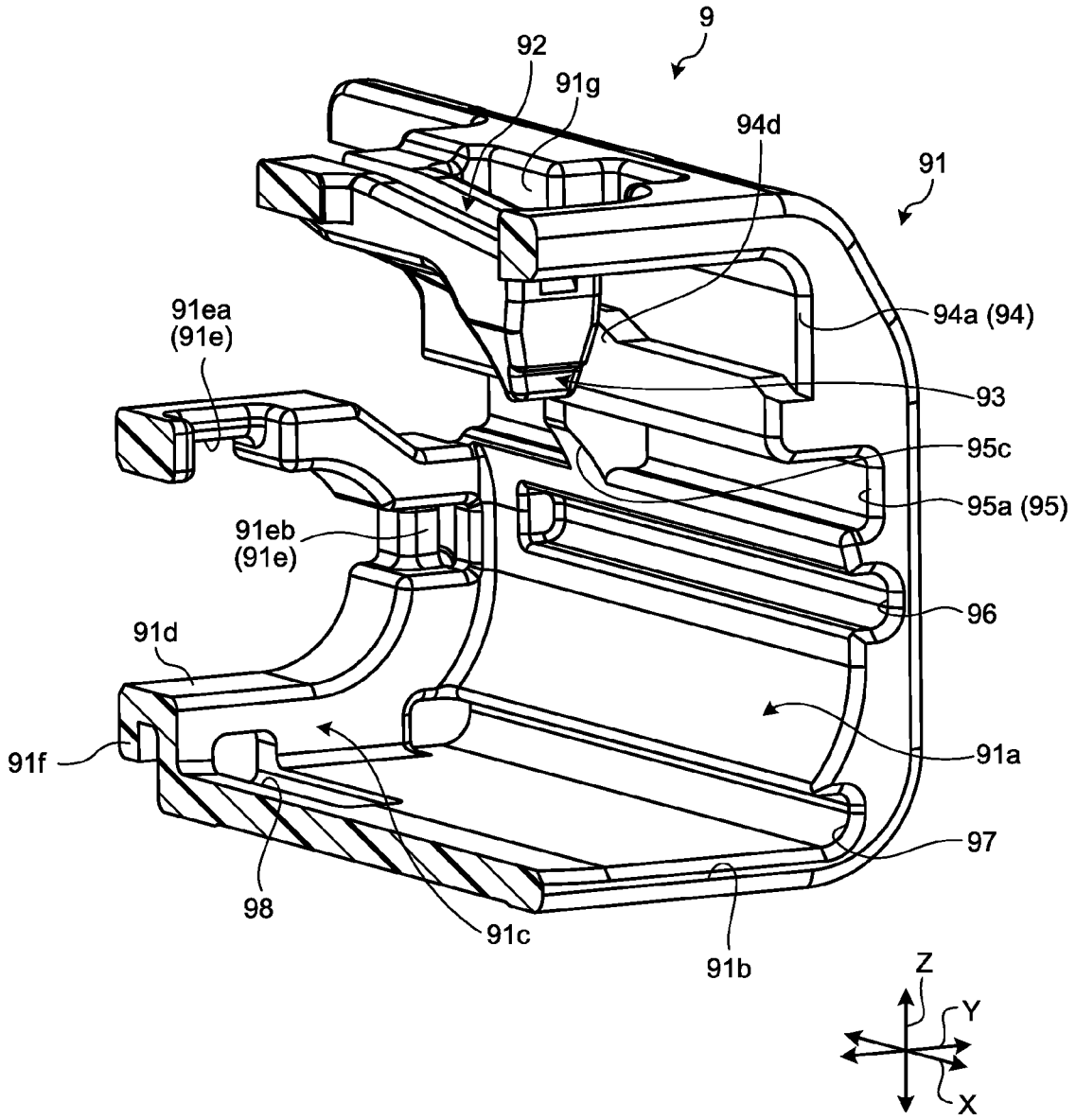
FIG. 5 is a partially cross-sectional perspective view illustrating a schematic configuration of a connector position assurance (CPA) member included in the female connector in accordance with the embodiment.

The CPA member 9 assembled with the female housing 7 is assembled so as to cover the outside of the female housing 7, and is a member for detecting complete engagement between the male connector 2 and the female housing 7 and is a functional member for implementing what is called a connector position assurance (CPA): engagement assurance function as illustrated in FIGS. 2, 3, 5, and the like. The CPA member 9 is assembled with the female housing 7 in a relatively movable manner along the axial direction X. A state where the male connector 2 and the female housing 7 are completely engaged with each other means a state where the female housing 7 is engaged with the engagement space 52 of the male housing 5 at a proper engagement position, typically, an engagement state where the female lock 73 is locked with the male beak 54 so as to secure a proper electric connection between the female terminals 6 and the male terminals 4.

Specifically, the CPA member 9 includes a CPA main body 91 assembled with the female housing 7, a CPA lock arm 92 extending from the CPA main body 91, and a CPA lock 93 as a second lock formed on the CPA lock arm 92. The CPA main body 91 is formed in substantially a rectangular cylindrical shape where an axis line is along the axial direction X. The CPA lock arm 92 is supported in a cantilever shape at an end part of the CPA main body 91 on the rear side in the axial direction X, and extends toward the front side along the axial direction X. The CPA lock 93 is formed at the end part of the CPA lock arm 92 on the front side in the axial direction X. The CPA lock arm 92 and the CPA lock 93 form a lock mechanism for locking the CPA member 9 with the female housing 7. The CPA member 9 is formed by integrating the CPA main body 91, the CPA lock arm 92, and the CPA lock 93 with an insulating synthetic resin material and the like.

The CPA main body 91 is a part that is attached to the female housing 7 so as to cover the outside of the female housing 7, in other words, a part in which the female housing 7 is inserted and held. The CPA main body 91 is formed in substantially a rectangular cylindrical shape as described above, and has a holding chamber 91*a* formed therein. The holding chamber 91*a* is a space in which the female housing 7 can be inserted along the axial direction X, and that holds the female housing 7 in a relatively movable manner. The holding chamber 91*a* extends inside the CPA main body 91 and is formed in a hollow shape so as to house the female housing 7. The holding chamber 91*a* extends along the axial direction X. The holding chamber 91*a* is formed as a space having a size and a shape capable of having the female housing 7 inserted therein depending on an outer shape of the female housing 7. In the holding chamber 91*a*, a housing insertion aperture 91*b* is formed on the front side in the axial direction X, and the control wall 91*c* is provided to the rear side in the axial direction X. The housing insertion aperture 91*b* is open toward the outside of the CPA main body 91 on the front side in the axial direction X as an aperture in which the female housing 7 is inserted. In the CPA main body 91, the female housing 7 is inserted in the holding chamber 91*a* through the housing insertion aperture 91*b*. The control wall 91*c* is a part that contacts the control end surface 77 of the female housing 7 so as to control relative movement between the female housing 7 and the CPA member 9 along the axial direction X at a predetermined position (engagement assurance position of the CPA member 9, which will be described later). The control wall 91*c* is formed so as to close a part of the aperture of the CPA main body 91 on the rear side in the axial direction X. The cylindrical units 78 of the female housing 7 can pass through the control wall 91*c* in the axial direction X, and a through-hole 91*d* to which the cover member 10 is attached is formed on the control wall 91*c*. The through-hole 91*d* is formed in substantially an oval shape along the width direction Y. A locked unit 91*e* with which the cover member 10 is locked is formed around the through-hole 91*d* on the control wall 91*c* (see FIGS. 3, 5, and the like). The locked unit 91*e* is formed as a beam-shaped part that can lock a locking claw 19 (see FIG. 2 and the like), which will be described later, in a recessed part formed facing the through-hole 91*d* on the control wall 91*c*. In the embodiment, a plurality of locked units 91*e* are formed. One locked unit 91*e* is provided to one side of the through-hole 91*d* in the height direction Z (side opposite to a side where a fourth guide recessed part 97, which will be described later, is disposed), and one locked unit 91*e* is provided to each of both sides of the through-hole 91*d* in the width direction Y, in other words, three locked units 91*e* are provided in total. When described distinctively, three locked units 91*e* may be referred to as locked units 91*ea*, 91*eb*, and 91*ec* for convenience. The locked unit 91*ea* is provided to the one side of the through-hole 91*d* in the height direction Z, and the locked units 91*eb* and 91*ec* are each provided to both sides of the through-hole 91*d* in the width direction Y. In the CPA main body 91, a flange 91*f* (see FIGS. 3, 5, and the like) for hooking a part of the cover member 10 is formed on the control wall 91*c*. The flange 91*f* is provided to the other side of the control wall 91*c* in the height direction Z (side where the fourth guide recessed part 97, which will be described later, is disposed), in the embodiment, to a side opposite to a side to which the through-hole 91*d* is provided. The flange 91*f* is formed in such a shape that an inner wall surface of the through-hole 91*d* on the control wall 91*c* projects toward the rear side in the axial direction X and is folded along the height direction Z.

In addition, the CPA main body 91 includes a pair of first guide recessed parts 94, a pair of second guide recessed parts 95, a third guide recessed part 96, and the fourth guide recessed part 97 on the inner surfaces on the holding chamber 91*a* side, in other words, out of inner surfaces facing the holding chamber 91*a* and partitioning the holding chamber 91*a*, on the inner surfaces opposed to each other in the width direction Y. Each of the first guide recessed parts 94, the second guide recessed parts 95, the third guide recessed part 96, and the fourth guide recessed part 97 is a part in which a part of the female housing 7 or a part of the male housing 5 is inserted, and that can guide the part of the female housing 7 or the male housing 5 along the axial direction X. The first guide recessed parts 94, the second guide recessed parts 95, the third guide recessed part 96, and the fourth guide recessed part 97 are provided on the inner surfaces of the CPA main body 91 along the height direction Z from one side toward the other side in the height direction Z in the order of the first guide recessed parts 94, the second guide recessed parts 95, the third guide recessed part 96, and the fourth guide recessed part 97. Each of the first guide recessed parts 94, the second guide recessed parts 95, the third guide recessed part 96, and the fourth guide recessed part 97 is formed in a recessed shape recessed along the width direction Y, and extends along the axial direction X. The first guide recessed parts 94 are formed at positions opposed to each other with respect to the width direction Y. When described distinctively, two first guide recessed parts 94 may be referred to as first guide recessed parts 94*a* and 94*b* for convenience. The first guide recessed part 94*a* is formed at a position opposed to the projective ribs 72*fa*, 72*ga*, and 72*ha* of the female lock arm 72 of the female housing 7 with respect to the axial direction X, and has the projective ribs 72*fa*, 72*ga*, and 72*ha* inserted therein and guidably supports the projective ribs 72*fa*, 72*ga*, and 72*ha* along the axial direction X. The first guide recessed part 94*b* is formed at a position opposed to the projective ribs 72*fb*, 72*gb*, and 72*hb* of the female lock arm 72 of the female housing 7 with respect to the axial direction X, and has the projective ribs 72*fb*, 72*gb*, and 72*hb* inserted therein and guidably supports the projective ribs 72*fb*, 72*gb*, and 72*hb* along the axial direction X. The second guide recessed parts 95 are formed at positions opposed to each other with respect to the width direction Y. When described distinctively, two second guide recessed parts 95 may be referred to as second guide recessed parts 95*a* and 95*b* for convenience. The second guide recessed part 95*a* is formed at a position opposed to the control projection 76*a* of the female main body 71 of the female housing 7 and the projective rib 53*a* of the male housing 5 with respect to the axial direction X, and has the control projection 76*a* and the projective rib 53*a* inserted therein and guidably supports the control projection 76*a* and the projective rib 53*a* along the axial direction X. The second guide recessed part 95*b* is formed at a position opposed to the control projection 76*b* of the female main body 71 of the female housing 7 and the projective rib 53*d* of the male housing 5 with respect to the axial direction X, and has the control projection 76*b* and the projective rib 53*d* inserted therein and guidably supports the control projection 76*b* and the projective rib 53*d* along the axial direction X. The third guide recessed part 96 is formed at a position opposed to the projective rib 53*b* of the male housing 5 with respect to the axial direction X, and has the projective rib 53*b* inserted therein and guidably supports the projective rib 53*b* along the axial direction X. The fourth guide recessed part 97 is formed at a position opposed to the projective rib 75 of the female main body 71 of the female housing 7 and the projective rib 53*c* of the male housing 5 with respect to the axial direction X, and has the projective rib 75 and the projective rib 53*c* inserted therein and guidably supports the projective rib 75 and the projective rib 53*c* along the axial direction X. Furthermore, the CPA main body 91 includes a fifth guide recessed part 98 (see FIG. 5) on the inner surface on the holding chamber 91*a* side, in other words, out of inner surfaces facing the holding chamber 91*a* and partitioning the holding chamber 91*a*, on the one inner surface in the height direction Z (inner surface on the fourth guide recessed part 97 side). The fifth guide recessed part 98 is formed in a recessed shape recessed along the height direction Z, and extends along the axial direction X. The fifth guide recessed part 98 extends from a middle part to the end part on the rear side in the axial direction X. The fifth guide recessed part 98 is formed at a position opposed to the control projection 76*c* of the female main body 71 of the female housing 7 with respect to the axial direction X, and is engaged with the control projection 76*c* and guidably supports the control projection 76*c* along the axial direction X. The CPA main body 91 also has a spacer insertion aperture 99 for inserting the spacer 8 in the spacer engagement unit 71*b* of the female main body 71 formed at a position adjacent to the second guide recessed part 95*b* in the height direction Z.

In the CPA main body 91, a locking projection 94*c* and a control projection 94*d* project in each of the first guide recessed parts 94. The locking projection 94*c* is formed at the end part of each of the first guide recessed parts 94 on the rear side in the axial direction X. The locking projection 94*c* is a part that is locked between the projective ribs 72*g* and 72*h* of the female lock arm 72 in a state wherein the CPA member 9 is disposed at a predetermined position (engagement assurance position of the CPA member 9, which will be described later). The control projection 94*d* is formed at the middle part of each of the first guide recessed parts 94 in the axial direction X. The control projection 94*d* is a part that contacts the projective rib 72*f* of the female lock arm 72 of the female housing 7 so as to control relative movement between the female housing 7 and the CPA member 9 along the axial direction X at a predetermined position (engagement assurance position of the CPA member 9, which will be described later). Moreover, in the CPA main body 91, the control projection 95*c* projects in each of the second guide recessed parts 95. The control projection 95*c* is formed at the middle part of each of the second guide recessed parts 95 in the axial direction X. The control projection 95*c* is a part that contacts the control projections 76 of the female main body 71 of the female housing 7 so as to control relative movement between the female housing 7 and the CPA member 9 along the axial direction X at a predetermined position (initial position of the CPA member 9, which will be described later).

The CPA lock arm 92 is a part that is formed in substantially a rectangular columnar shape by projecting toward an aperture 91*g* of the CPA main body 91. The aperture 91*g* is formed on a surface of the CPA main body 91 on one side in the height direction Z, in the embodiment, a surface on a side where the first guide recessed parts 94 are disposed, in other words, a surface opposed to a surface to which the fifth guide recessed part 98 is provided in the height direction Z. The CPA lock arm 92 is supported by an edge part of the aperture 91*g* on the rear side in the axial direction X, and is formed by extending in a cantilever shape that has flexibility toward the front side along the axial direction X. The CPA lock arm 92 extends in the holding chamber 91*a*. The CPA lock arm 92 is disposed substantially at the center part of the CPA main body 91 with respect to the width direction Y. The CPA lock arm 92 is supported in a cantilever shape capable of elastically deforming at the base end part on the rear side in the axial direction X, and has a free end at the tip on the front side in the axial direction X. In this manner, the CPA lock arm 92 is supported in an elastically deformable manner along the height direction Z with respect to the base end part. The CPA lock 93 is formed on the tip of the CPA lock arm 92 on the front side in the axial direction X.

The CPA lock 93 is a part that can be locked with the female lock 73 in a state where the CPA member 9 is assembled with the female housing 7 and is disposed at a predetermined position (engagement assurance position of the CPA member 9, which will be described later). The CPA lock 93 is formed by projecting from the tip of the CPA lock arm 92 on the front side in the axial direction X toward the holding chamber 91*a* side along the height direction Z. The CPA lock 93 is disposed between the cantilever beam-shaped units 72*b* (see FIG. 1 and the like) in a state where the CPA member 9 is assembled with the female housing 7.

Figure 6:
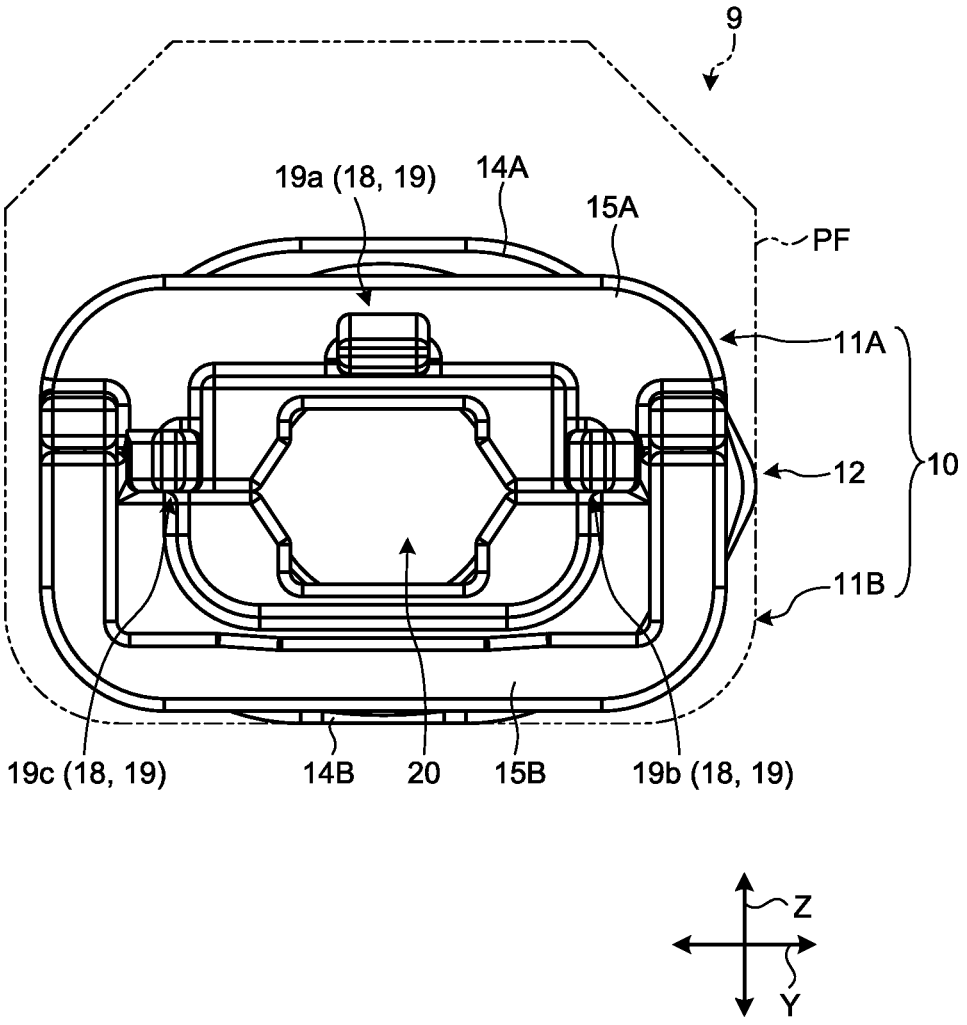
FIG. 6 is a front view illustrating a cover member included in the female connector in accordance with the embodiment when viewed in the axial direction.

The cover member 10 assembled with the CPA member 9 is a member that is assembled with the CPA member 9 through a locking unit 18 locked with the CPA member 9 as illustrated in FIGS. 2, 3, 6, and the like. The cover member 10 in the embodiment functions as a member that covers an end part of a corrugated tube CT (see FIG. 1) serving as an exterior member of the electric wire W2 connected to the female connector 3.

Specifically, the cover member 10 includes a first divided body 11A, a second divided body 11B, and a hinge connecting unit 12, and is formed by integrating the first divided body 11A, the second divided body 11B, and the hinge connecting unit 12 with an insulating synthetic resin material and the like. The cover member 10 is formed in a cylindrical shape by assembling the first divided body 11A with the second divided body 11B, and has the end part of the corrugated tube CT (see FIG. 1) inserted therein and holds the corrugated tube CT.

The first divided body 11A and the second divided body 11B include main bodies 13A and 13B, first flanges 14A and 14B, and second flanges 15A and 15B, respectively, and the first divided body 11A and the second divided body 11B are formed by integrating the main bodies 13A and 13B, the first flanges 14A and 14B, and the second flanges 15A and 15B, respectively. Each of the main bodies 13A and 13B is formed in substantially a semi-cylindrical shape, in other words, in a gutter shape, and has a holding recessed and projecting part 16 formed on the inner periphery surface. The holding recessed and projecting part 16 projects from the inner periphery surface toward the inside in the radial direction of the main bodies 13A and 13B, and extends along the inner periphery surface in a periphery direction. A plurality of holding recessed and projecting parts 16 are provided to the inner periphery surface of the main bodies 13A and 13B at intervals along the axial direction X. Each of the holding recessed and projecting parts 16 is a part that bites in a recessed and projecting part formed on the outer periphery surface of the corrugated tube CT, and locks the corrugated tube CT with inner periphery surface sides of the main bodies 13A and 13B. The first flanges 14A and 14B are provided to one end surfaces of the main bodies 13A and 13B in the axial direction X, respectively, and the second flanges 15A and 15B are provided to other end surfaces of the main bodies 13A and 13B in the axial direction X, respectively. The first flanges 14A and 14B are formed by projecting from the one end surfaces of the main bodies 13A and 13B in the axial direction X toward the outside in the radial direction, respectively. In the embodiment, the first flanges 14A and 14B are formed in substantially semi-arc frame shapes. The second flanges 15A and 15B are formed by projecting from the other end surfaces of the main bodies 13A and 13B in the axial direction X toward the outside in the radial direction, respectively. In the embodiment, the second flanges 15A and 15B are formed in substantially rectangular frame shapes.

In the cover member 10, the first divided body 11A and the second divided body 11B formed as described above are connected to each other through the hinge connecting unit 12, and are mutually openable and closable using the hinge connecting unit 12 as a fulcrum. The hinge connecting unit 12 is formed in a plate piece shape that has flexibility, and, in the embodiment, connects the second flange 15A of the first divided body 11A to the second flange 15B of the second divided body 11B. The first divided body 11A and the second divided body 11B connected by the hinge connecting unit 12 are openable and closable at a closing position (see FIGS. 1, 2, 3, and the like) and an opening position (see FIG. 10, which will be described later, and the like). In the cover member 10, when the first divided body 11A and the second divided body 11B are disposed at the closing position, the main body 13A, the first flange 14A, and the second flange 15A of the first divided body 11A are opposed to the main body 13B, the first flange 14B, and the second flange 15B of the second divided body 11B, respectively, and are locked with the main body 13B, the first flange 14B, and the second flange 15B through a lock mechanism 17, respectively, so as to be integrated in a state where the first divided body 11A and the second divided body 11B are disposed at the closing position. In the cover member 10, when the first divided body 11A and the second divided body 11B are integrated at the closing position through the lock mechanism 17, the inner periphery surface of the main body 13A and the inner periphery surface of the main body 13B are opposed to each other and sandwich an end part of the corrugated tube CT (see FIG. 1), and each of the holding recessed and projecting parts 16 formed on the inner periphery surfaces bites in the corrugated tube CT and locks the corrugated tube CT. In this manner, the cover member 10 covers and holds the end part of the corrugated tube CT. By contrast, in the cover member 10, when the first divided body 11A and the second divided body 11B are disposed at the opening position, the main body 13A, the first flange 14A, and the second flange 15A of the first divided body 11A are separated from the main body 13B, the first flange 14B, and the second flange 15B of the second divided body 11B, respectively, and the inner periphery sides thereof are open to each other.

The cover member 10 includes the locking unit 18, and is assembled with the CPA member 9 through the locking unit 18. The locking unit 18 is a part that is locked with the locked units 91*e* formed on the CPA member 9, and in the embodiment, a plurality of locking units 18 are formed on a surface of the second flange 15A of the first divided body 11A on the front side in the axial direction X (surface on a side opposite to the main body 13A). One locking unit 18 is provided to one side of the second flange 15A in the height direction Z (side opposite to a side where the second flange 15B of the second divided body 11B is disposed), and one locking unit 18 is provided to each of both sides of the second flange 15A in the width direction Y, in other words, three locking units 18 are provided in total. All of the locking units 18 in the embodiment are provided inside an outer shape line PF of the CPA member 9 when viewed in a direction of the relative movement between the female housing 7 and the CPA member 9, in other words, in the axial direction X as illustrated in FIG. 6 so as to reduce an increase in size of the outer shape. The outer shape line PF of the CPA member 9 corresponds to a contour of a projection area in which the outer shape of the CPA member 9 is projected along the axial direction X.

More specifically, the locking units 18 in the embodiment include the locking claws 19 that are locked with the locked units 91*e* of the CPA member 9 and are bent when locked with the locked units 91*e* of the CPA member 9. When described distinctively, the locking claws 19 of three locking units 18 may be referred to as locking claws 19*a*, 19*b*, and 19*c* for convenience. The locking claw 19*a* is provided to one side of the second flange 15A in the height direction Z, and the locking claws 19*b* and 19*c* are provided to each of both sides of the second flange 15A in the width direction Y. In addition, the locking claws 19*a*, 19*b*, and 19*c* are formed at positions opposed to the locked units 91*ea*, 91*eb*, and 91*ec* with respect to the axial direction X, respectively. Each of the locking claws 19 includes an arm 19*d* and a claw 19*e* (see FIG. 2 and the like). The arm 19*d* is a part formed in a linear rod shape projecting from the second flange 15A to the female connector 3 on the front side in the axial direction X. The claw 19*e* is a part formed in a hook shape at the tip of the arm 19*d* on the front side in the axial direction X. The claw 19*e* of the locking claw 19*a* is formed by projecting from the arm 19*d* to the outside in the height direction Z, and the claws 19*e* of the locking claws 19*b* and 19*c* are formed by projecting from the arm 19*d* to the outside in the width direction Y. When the locking claws 19 are each locked with the locked units 91*e* of the CPA member 9, the claws 19*e* get over the locked units 91*e* and are engaged with the end surfaces of the locked units 91*e* on the front side in the axial direction X while the arms 19*d* are each bent. The cover member 10 is provided so that all of the locking claws 19 formed as above are disposed inside the outer shape line PF of the CPA member 9 when viewed in the axial direction X.

In addition, the cover member 10 in the embodiment includes an evacuation space 20 as a space for accommodating the locking claws 19 when the locking claws 19 are locked with the locked units 91*e* of the CPA member 9. In the cover member 10 in the embodiment, a space on a side surrounded by the two second flanges 15A and 15B, adding more, a space inside the locking claws 19 functions as the evacuation space 20. The claws 19*e* are formed by projecting toward a side opposite to this evacuation space 20. The evacuation space 20 in the embodiment functions as a space for accommodating the locking claws 19 when the locking claws 19 are locked with the locked units 91*e*, and also functions as a space for controlling the bending of the locking claws 19 by inserting a part of the female housing 7, in the embodiment, the cylindrical units 78 in the evacuation space 20 so as to control the locking of the locking claws 19 to be released and put the locking claws 19 in a lock state (see FIGS. 14, 15, which will be described later, and the like). In this case, the cylindrical units 78 are disposed outside the evacuation space 20 in a state where the female housing 7 and the CPA member 9 have predetermined positional relation (the CPA member 9 is disposed at an initial position, which will be described later) and are disposed inside the evacuation space 20 in a state where the female housing 7 and the CPA member 9 have another predetermined positional relation (the CPA member 9 is disposed at an engagement assurance position, which will be described later), whereby the cylindrical units 78 function as control units that control the bending of the locking claws 19.

In the female connector 3 formed as above, the female housing 7 is inserted in the holding chamber 91*a* from the CPA member 9 on the front side in the axial direction X through the housing insertion aperture 91*b* as illustrated in FIGS. 1, 2, 3, 4, and the like. In this case, in the female connector 3, the large diameter part 71A of the female housing 7 is inserted in the holding chamber 91*a*. More specifically, in the female connector 3, the projective ribs 72*fa*, 72*ga*, and 72*ha* are inserted in the first guide recessed part 94*a*, the projective ribs 72*fb*, 72*gb*, and 72*hb* are inserted in the first guide recessed part 94*b*, the control projection 76*a* is inserted in the second guide recessed part 95*a*, the control projection 76*b* is inserted in the second guide recessed part 95*b*, the projective rib 75 is inserted in the fourth guide recessed part 97, and the control projection 76*c* is engaged with the fifth guide recessed part 98. This positional relation causes relative movement between the female housing 7 and the CPA member 9 along the axial direction X to be guided. In the female connector 3, the control projections 76*a* and 76*b* of the female housing 7 get over the control projection 95*c* and are inserted to a position on the rear side of the control projection 95*c* in the axial direction X while bending a wall surface of the CPA main body 91 of the CPA member 9, and the control projection 76*c* is engaged with the fifth guide recessed part 98 so as to complete the assembling between the CPA member 9 and the female housing 7. In the female connector 3, in this state and with the positional relation where the axial direction of the female main body 71 is along with the axial direction of the CPA main body 91, the female housing 7 is held in the holding chamber 91*a* of the CPA main body 91, and the CPA lock 93 is disposed between the cantilever beam-shaped units 72*b* with respect to the width direction Y. In the female connector 3, the female terminal 6 is inserted in each of the terminal insertion chambers 71*a* formed on the female housing 7 from the rear side in the axial direction X through the female terminal insertion aperture 71*c*, and the spacer 8 is inserted in the spacer engagement unit 71*b* from one side in the width direction Y through the spacer insertion aperture 99 and the like so as to engage and hold the female terminal 6 at a regular position in each of the terminal insertion chamber 71*a*.

The operation of the female connector 3 formed as above and assembling of the cover member 10 will be described in detail with reference to FIGS. 7 to 14 and other drawings as appropriate.

In the female connector 3 in the embodiment, in a state where the CPA member 9 is assembled with the female housing 7 as above, the CPA member 9 is relatively movable between an initial position (see FIGS. 7, 12, and the like) and an engagement assurance position (see FIG. 14 and the like) along the axial direction X while being guided by the first guide recessed parts 94, the second guide recessed parts 95, the third guide recessed part 96, the fourth guide recessed part 97, and the fifth guide recessed part 98. The cover member 10 is assembled with the CPA member 9 through the locking units 18 in a state where the CPA member 9 is disposed at an initial position, and is in a lock state where releasing the locking of the locking units 18 is controlled in a state where the CPA member 9 is disposed at an engagement assurance position.

Figure 7:
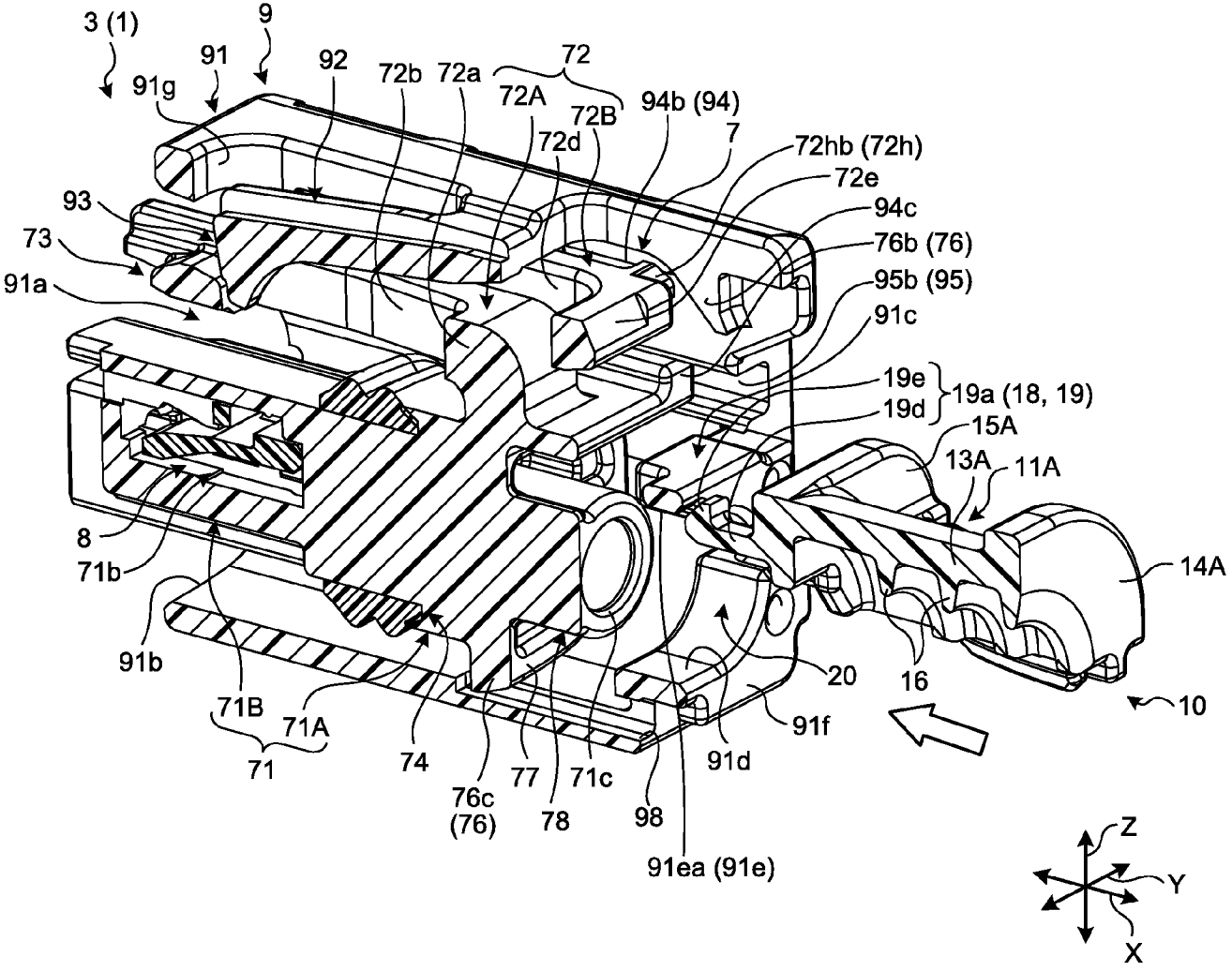
FIG. 7 is a partially cross-sectional perspective view illustrating operation of the connector mechanism in accordance with the embodiment.

The initial position of the CPA member 9 is a position at which the CPA member 9 is disposed before the male housing 5 of the male connector 2 and the female housing 7 of the female connector 3 are completely engaged with each other as illustrated in FIGS. 7, 12, and the like, typically, a position where the CPA lock 93 is disposed on the rear side from the female lock 73 in the axial direction X. The CPA member 9 is basically disposed at an initial position before the male housing 5 and the female housing 7 are completely engaged with each other. The initial position of the CPA member 9 is also a position for assembling the cover member 10 with the CPA member 9. When the CPA member 9 is disposed at the initial position, the front side end part of the CPA lock 93 in the axial direction X contacts the rear side end part of the female lock 73 in the axial direction X, and the CPA member 9 is in a state where relative movement to the female housing 7 on the front side in the axial direction X, in other words, the engagement assurance position, which will be described later, is controlled. Stated differently, when the male beak 54 is not interposed between the female lock 73 and the CPA lock 93 with respect to the axial direction X (see FIG. 12), in other words, when the female lock 73 does not get over the male beak 54 and is not locked with the male beak 54, the CPA lock 93 contacts the female lock 73, and the CPA member 9 is in a state where relative movement from the initial position to the engagement assurance position is controlled. In addition, when the CPA member 9 is disposed at the initial position, the control projection 95*c* (see FIG. 5 and the like) of the CPA main body 91 contacts the corresponding control projection 76 (see FIG. 3 and the like) of the female housing 7 so as to control the CPA member 9 to relatively move to the female housing 7 on the rear side in the axial direction X and control the female housing 7 to remove from the holding chamber 91*a*.

Figure 8:
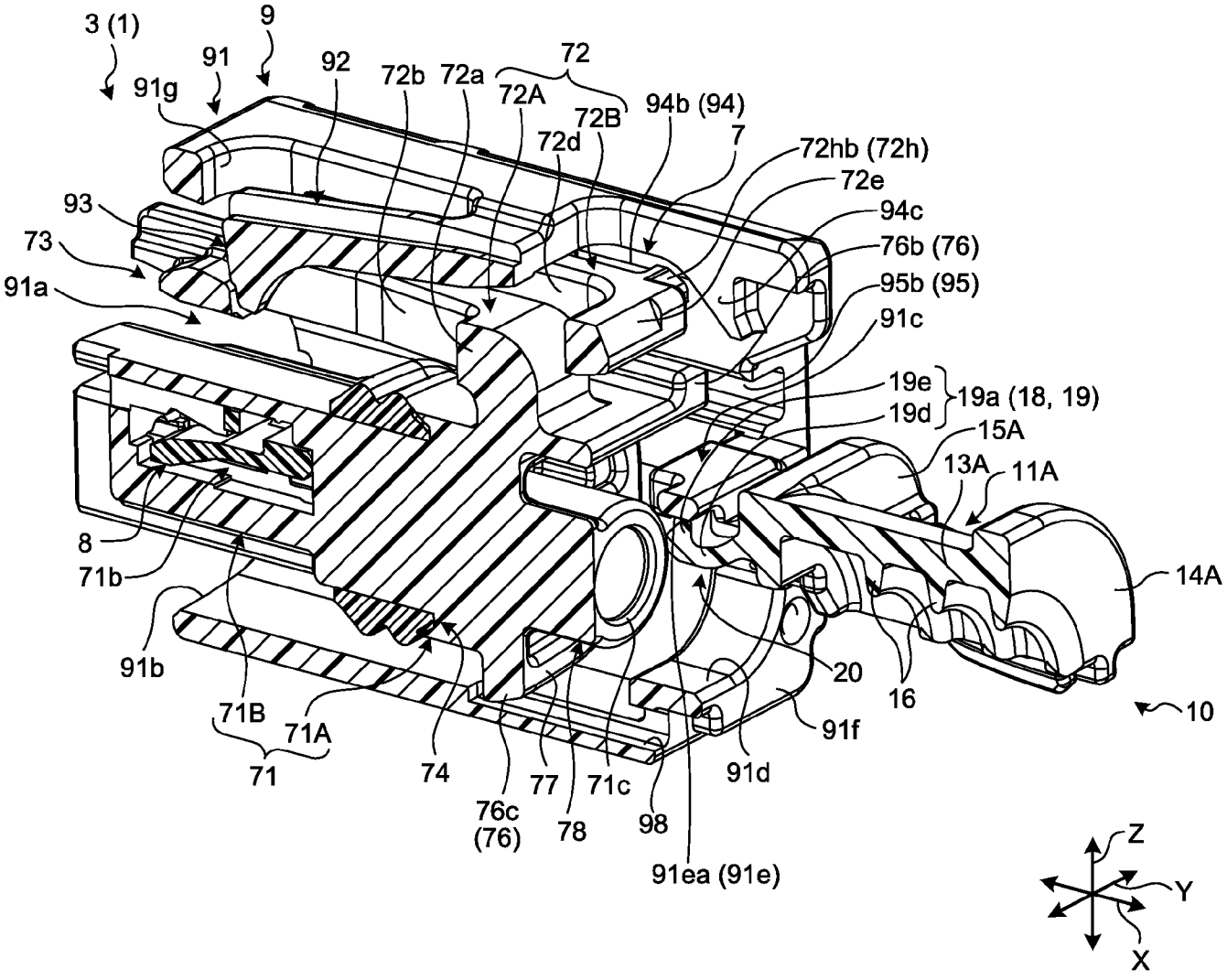
FIG. 8 is a partially cross-sectional perspective view illustrating operation of the connector mechanism in accordance with the embodiment.
Figure 9:
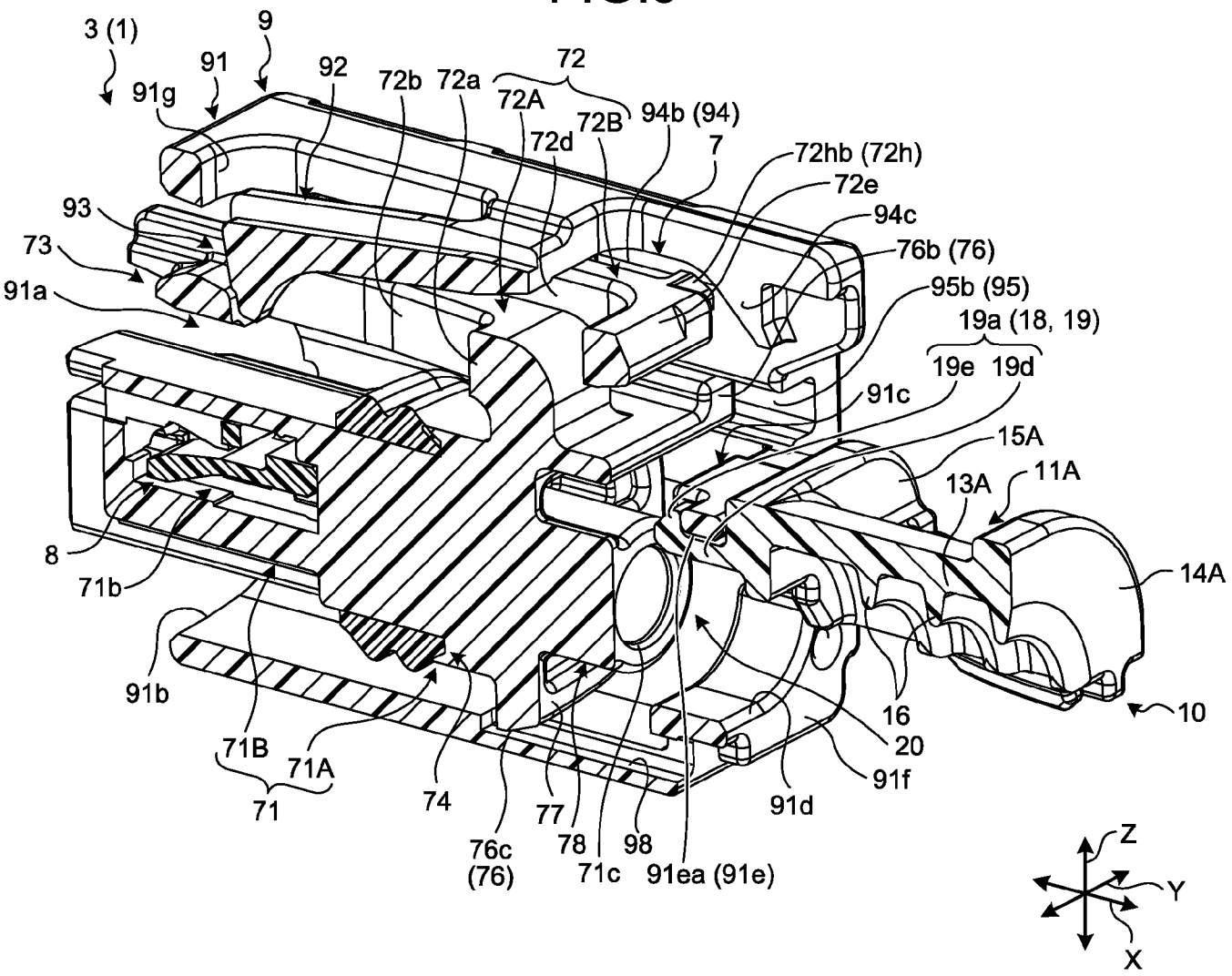
FIG. 9 is a partially cross-sectional perspective view illustrating operation of the connector mechanism in accordance with the embodiment.

In the female connector 3, the CPA member 9 is assembled with the female housing 7, and the cover member 10 is assembled with the CPA member 9 in a state where the CPA member 9 is disposed at the initial position as illustrated in FIG. 7. In the female connector 3, when the CPA member 9 is disposed at the initial position, the cylindrical units 78 are disposed outside the evacuation space 20. In the female connector 3 in this state, each of the locking units 18 of the cover member 10 is inserted in the through-hole 91*d* of the CPA member 9 along the axial direction X from the rear side in the axial direction X so as to assemble the cover member 10. In this case, the first divided body 11A and the second divided body 11B are disposed at the opening position (see FIG. 10), and the cover member 10 is pressed to the CPA member 9 side along the axial direction X with the positional relation where the locking claws 19*a* and 19*b* (see FIG. 2 and the like) are opposed to the locked units 91*ea* and 91*eb* (see FIG. 3 and the like) with respect to the axial direction X, respectively, and the locking claw 19*c* (see FIG. 2 and the like) is opposed to the locked unit 91*ec* (FIG. 3 and the like). In this manner, in the cover member 10, the claws 19*e* get over the locked units 91*e* while the arm 19*d* of each of the locking claws 19 is bent to the evacuation space 20 side as illustrated in FIG. 8, and eventually, the claws 19*e* of each of the locking claws 19 are locked with the end surface of the locked units 91*e* on the axial direction X front side as illustrated in FIG. 9. Thus, the cover member 10 becomes locked with each of the locked units 91*e* of the CPA member 9 through each of the locking claws 19.

Figure 10:
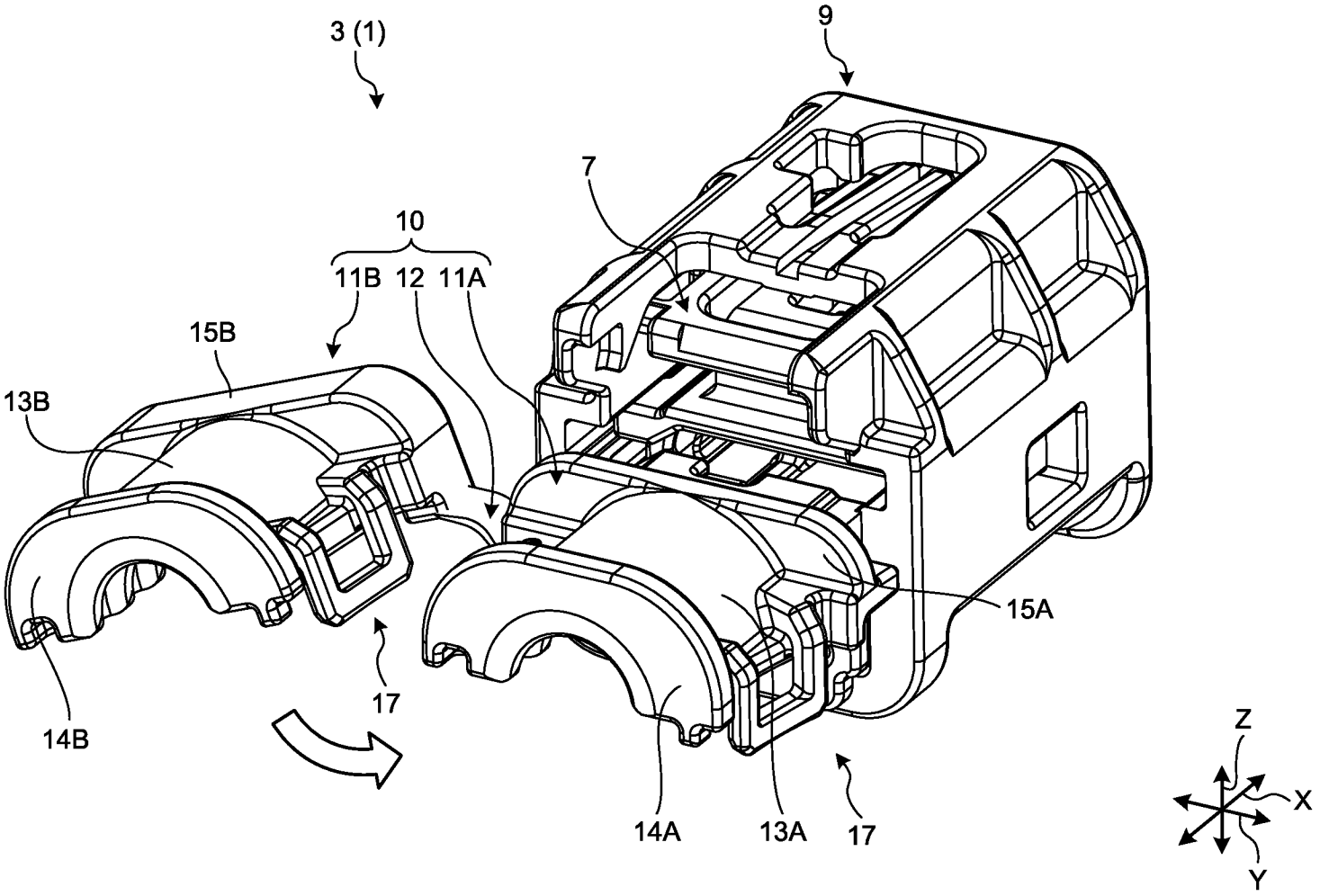
FIG. 10 is a perspective view illustrating operation of the connector mechanism in accordance with the embodiment.
Figure 11:
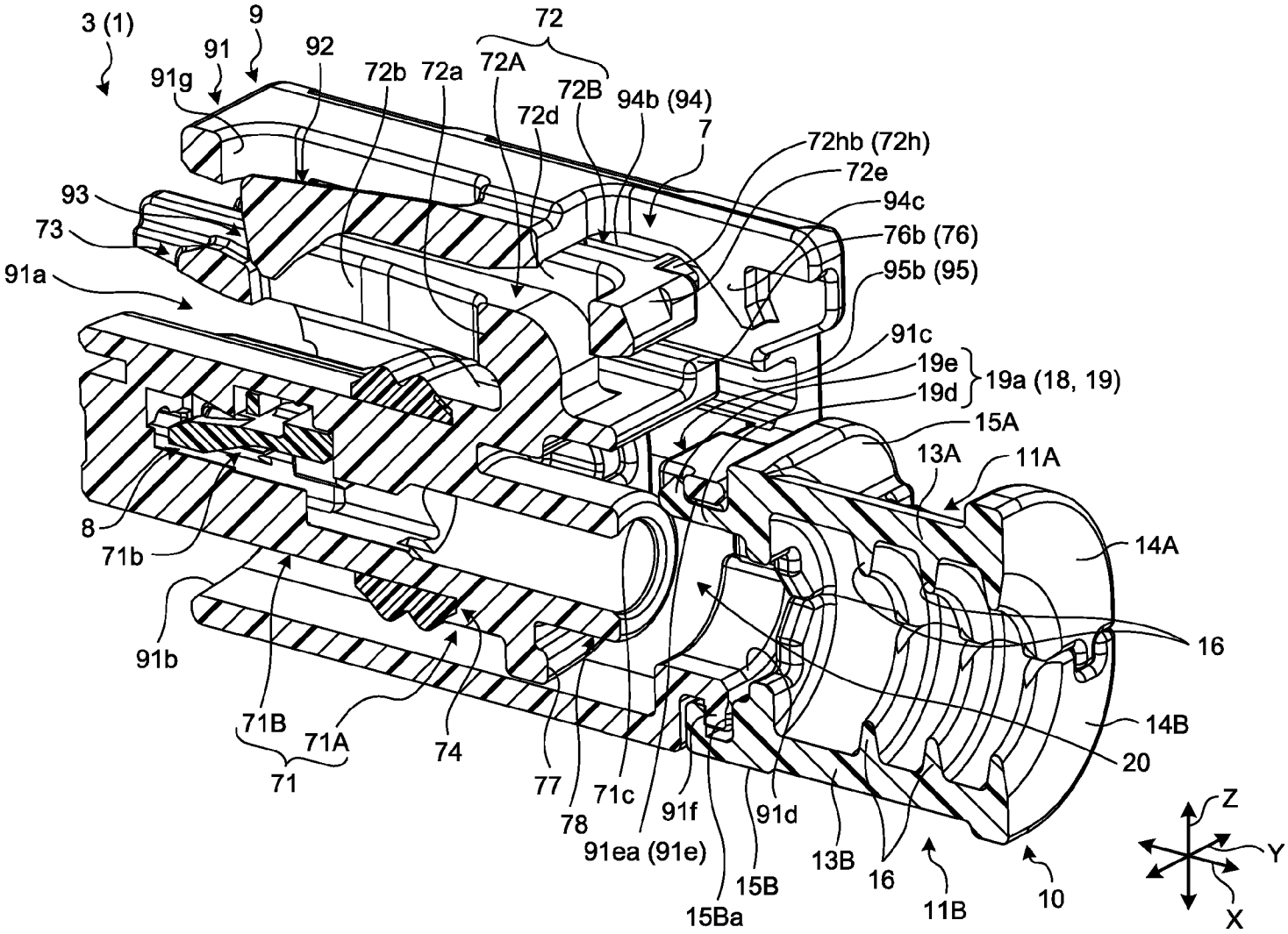
FIG. 11 is a partially cross-sectional perspective view illustrating operation of the connector mechanism in accordance with the embodiment.

In the cover member 10, an end part of the corrugated tube CT (see FIG. 1) is installed on the inner periphery surface side of the main body 13A on which the holding recessed and projecting parts 16 are formed in the first divided body 11A, and, in this state, as indicated by the arrow in FIG. 10, the first divided body 11A and the second divided body 11B are disposed at the closing position, and are locked with each other through the lock mechanism 17 so as to be integrated. In this manner, in the cover member 10, the first divided body 11A and the second divided body 11B cover and hold the end part of the corrugated tube CT. In addition, in the cover member 10, the first divided body 11A and the second divided body 11B are set to be disposed at the closing position so as to engage the flange 91*f* on the CPA member 9 side with a recessed part 15Ba formed on the second flange 15B as illustrated in FIG. 11. In this manner, in the cover member 10, the second divided body 11B side is also disposed and fixed to the control wall 91*c* of the CPA member 9 with certainty.

In the connector mechanism 1, the female connector 3 and the male connector 2 are engaged with each other in a state where the CPA member 9 is disposed at an initial position and the cover member 10 is assembled with the CPA member 9 as illustrated in FIG. 12. In this case, in the connector mechanism 1, the small diameter part 71B of the female housing 7 is inserted in and engaged with the engagement space 52 of the male housing 5, the projective rib 53*a* is inserted in the second guide recessed part 95*a*, the projective rib 53*d* is inserted in the second guide recessed part 95*b*, the projective rib 53*b* is inserted in the third guide recessed part 96, and the projective rib 53*c* is inserted in the fourth guide recessed part 97 so as to guide relative movement among the female housing 7, the CPA member 9, and the male housing 5 along the axial direction X with this positional relation. In the connector mechanism 1, the female housing 7 and the CPA member 9 are pressed to the male housing 5 side, and when the female housing 7, the CPA member 9, and the male housing 5 approach one another due to relative movement along the axial direction X, the female lock 73 and the CPA lock 93 run on the male beak 54 while the female lock arm (the first arm 72A and the second arm 72B) and the CPA lock arm 92 are bent in association with the relative movement. After that, in the connector mechanism 1, the female lock 73 gets over and is locked with the male beak 54, and the male housing 5 and the female housing 7 become completely engaged with each other in association with the further relative movement of the female housing 7, the CPA member 9, and the male housing 5 as illustrated in FIG. 13. In this state, the connector mechanism 1 secures a proper electric connection between the female terminals 6 and the male terminals 4. In this state, in other words, in a state where the female lock 73 gets over and is locked with the male beak 54 and the male beak 54 is interposed between the female lock 73 and the CPA lock 93 with respect to the axial direction X, the CPA lock 93 runs on the male beak 54, and the CPA member 9 can move from an initial position to the engagement assurance position. In the connector mechanism 1, in a state where the male housing 5 and the female housing 7 are completely engaged with each other, the CPA member 9 is pressed from an initial position toward the front side in the axial direction X so as to move to the engagement assurance position.

The engagement assurance position of the CPA member 9 is a position at which the CPA member 9 is movable after the female housing 7 of the female connector 3 is completely engaged with the male housing 5 of the male connector 2 as illustrated in FIG. 14 and the like, and a position where the CPA member 9 is pushed from an initial position to the front side in the axial direction X. In addition, the engagement assurance position of the CPA member 9 is a position at which complete engagement between the male housing 5 and the female housing 7 is detected and assured, typically, a position at which the CPA lock 93 gets over the male beak 54 and the female lock 73 locked with the male beak 54 in order, and is locked with the female lock 73. The CPA member 9 is basically moved to the engagement assurance position in a state after the male housing 5 and the female housing 7 are completely engaged with each other. When the CPA member 9 is disposed at the engagement assurance position, the rear side end part of the CPA lock 93 in the axial direction X contacts the front side end part of the female lock 73 in the axial direction X, and the CPA member 9 becomes in a state where relative movement to the female housing 7 on the rear side in the axial direction X, in other words, the initial position side is controlled. In addition, when the CPA member 9 is disposed at the engagement assurance position, the control projection 94*d* (see FIG. 5 and the like) of the CPA member 9 contacts the projective ribs 72*f* (see FIG. 3 and the like) of the female housing 7 or the control wall 91*c* of the CPA member 9 contacts the control end surface 77 of the female housing 7, whereby further relative movement to the female housing 7 on the front side in the axial direction X is controlled. Furthermore, when the CPA member 9 is disposed at the engagement assurance position, the locking projection 94*c* (see FIG. 3 and the like) of the CPA main body 91 is locked between each of the projective ribs 72*g* (see FIG. 3 and the like) and each of the projective ribs 72*h* (see FIG. 3 and the like) of the female housing 7, and the state where the CPA member 9 is disposed at the engagement assurance position is surely maintained.

As described above, the CPA member 9 can move from an initial position to the engagement assurance position in a state where the female lock 73 is locked with the male beak 54, and the CPA lock 93 gets over the male beak 54 and the female lock 73 locked with the male beak 54 in this order and is locked with the female lock 73 at the engagement assurance position in association with the movement from the initial position to the engagement assurance position. In other words, in the connector mechanism 1, if the female housing 7 is not completely engaged with the male housing 5, the CPA member 9 cannot move from the initial position to the engagement assurance position, and the CPA lock 93 is not locked with the female lock 73. Stated differently, in the connector mechanism 1, movement of the CPA member 9 from the initial position to the engagement assurance position can assure complete engagement between the male housing 5 and the female housing 7. By contrast, in the connector mechanism 1, the initial position of the CPA member 9 and an intermediate position before the CPA member 9 reaches the engagement assurance position from the initial position correspond to the engagement non-assurance position where complete engagement between the male housing 5 and the female housing 7 is not assured.

Figure 15:
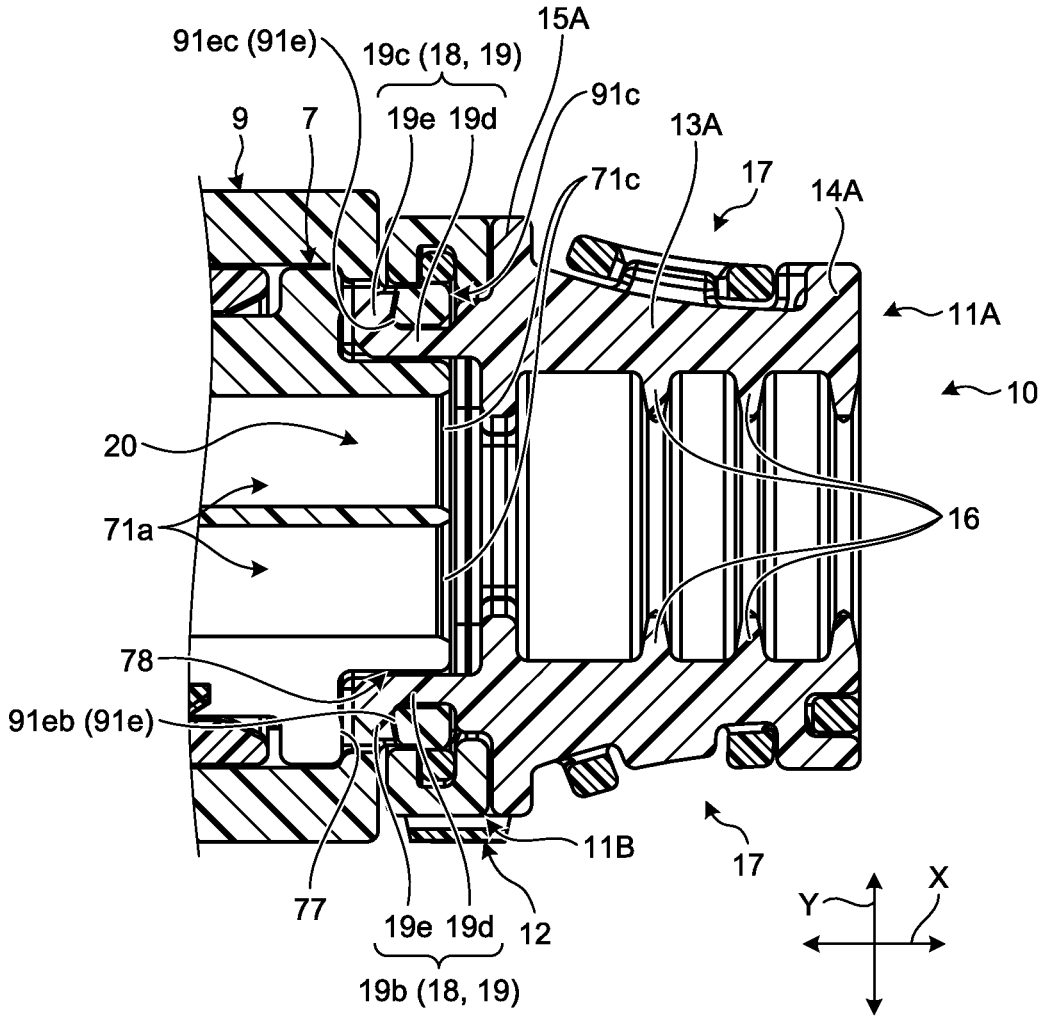
FIG. 15 is a partially cross-sectional view illustrating operation of the connector mechanism in accordance with the embodiment.

In the connector mechanism 1, when the CPA member 9 is disposed at the engagement assurance position, the cylindrical units 78 on the control end surface 77 are disposed so as to advance in the through-hole 91*d* of the control wall 91*c* as illustrated in FIGS. 14 and 15. In this manner, the cylindrical units 78 of the female housing 7 enter the evacuation space 20 of the cover member 10, and the cylindrical units 78 control the bending of each of the locking claws 19 (locking claws 19*a*, 19*b*, and 19*c*). Thus, the female connector 3 is in a lock state where releasing the engagement of the locking claws 19 is controlled.

The female connector 3 described as above includes the female housing 7 that is provided with the female terminals 6 connected to the male terminals 4 of the male connector 2 and can be engaged with the male connector 2, the CPA member 9 that is assembled with the female housing 7 in a relatively movable manner from the initial position to the engagement assurance position in a state where the male connector 2 and the female housing 7 are completely engaged with each other, and the cover member 10 that is assembled with the CPA member 9 through the locking units 18 locked with the CPA member 9. The locking units 18 are provided inside the outer shape line PF of the CPA member 9 when viewed in a direction of the relative movement between the female housing 7 and the CPA member 9.

The locking units 18 for locking the cover member 10 with the CPA member 9 are provided inside the outer shape line PF of the CPA member 9 when viewed in a direction of the relative movement between the female housing 7 and the CPA member 9, in the embodiment, in the axial direction X, and a part projecting from the outer shape line PF of the CPA member 9 does not exist in the locking units 18. Thus, the female connector 3 can reduce an increase in size of an outer shape and achieve miniaturization.

Figure 16:
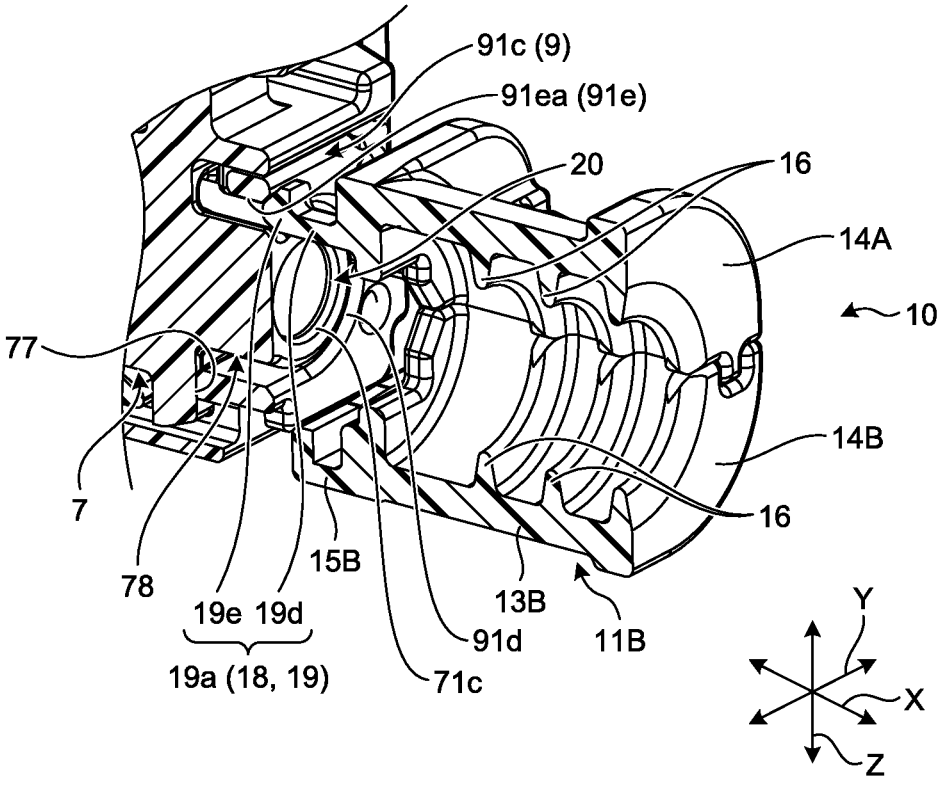
FIG. 16 is a partially cross-sectional perspective view illustrating operation of the connector mechanism in accordance with the embodiment.

In addition, in the female connector 3 described as above, the locking units 18 are locked with the CPA member 9 and include the locking claws 19 that are bent when locked with the CPA member 9, the cover member 10 includes the evacuation space 20 that accommodates the locking claws 19 when the locking claws 19 are bent, and the female housing 7 includes the cylindrical units 78 that control the bending of the locking claws 19 by being disposed outside the evacuation space 20 in a state where the CPA member 9 is disposed at the initial position or by being disposed inside the evacuation space 20 in a state where the CPA member 9 is disposed at the engagement assurance position. Thus, in the female connector 3, when the CPA member 9 is disposed at the engagement assurance position, the cylindrical units 78 function as displacement prevention units of the locking claws 19, and control the locking claws 19 forming the locking units 18 to be bent by entering the evacuation space 20 of the cover member 10. In this manner, the female connector 3 can surely control the locking of the locking claws 19 to be released, for example, if a tensile force toward the rear side in the axial direction X acts on the cover member 10, and improve a locking holding force of the locking claws 19. In addition, in the female connector 3 in the embodiment, a control piece 72*i* (see FIG. 14) formed near the base end part 72*a* of the female housing 7 controls the locked units 91*e* (especially, the locked unit 91*ea*) on the CPA member 9 side with which the locking claws 19 are locked to be deformed. In this point, the female connector 3 can improve a locking holding force of the locking claws 19. Thus, the female connector 3 can surely maintain a lock state between the CPA member 9 and the cover member 10 through the locking claws 19 forming the locking units 18. Because the cylindrical units 78 functioning as displacement prevention units are disposed outside the evacuation space 20 in a state where the CPA member 9 is disposed at an initial position, the female connector 3 can allow the locking claws 19 to be bent to the evacuation space 20 side, and to get over and be locked with the locked units 91*e*. Thus, when the CPA member 9 is disposed at an initial position, the cover member 10 can be assembled with the CPA member 9. In other words, in the female connector 3, if the cover member 10 is not yet assembled and the CPA member 9 is disposed at the engagement assurance position, the locking claws 19 cannot be bent and be locked with the locked units 91*e* by contacting the cylindrical units 78 disposed inside the evacuation space 20, and the cover member 10 cannot be assembled with the CPA member 9 as illustrated in FIG. 16. The female connector 3 can detect which position the CPA member 9 is disposed using this configuration. In other words, the female connector 3 can detect a position of the CPA member 9 that is the engagement assurance position by the fact that the cover member 10 cannot be assembled with the CPA member 9, and can detect a position of the CPA member 9 that is the initial position by the fact that the cover member 10 can be assembled with the CPA member 9. For example, when the CPA member 9 is temporarily moved to the engagement assurance position using a jig and the like, the female terminals 6 and the spacer 8 are assembled with the female housing 7 in this state, and the CPA member 9 is returned to the initial position, the female connector 3 can detect and prevent failure of returning the CPA member 9 to the initial position using the fact that the position of the CPA member 9 can be detected based on whether or not the cover member 10 is assembled as described above.

In the female connector 3 described as above, the cylindrical units 78 contact the locking claws 19 in a state where the locking claws 19 are bent and are evacuated to the evacuation space 20 so as to prevent the CPA member 9 from moving from the initial position to the engagement assurance position. Stated differently, in the female connector 3, for example, when the locking claws 19 are bent and are evacuated to the evacuation space 20, but are not yet locked with the locked units 91*e*, in other words, when the locking claws 19 are in a semi-lock state where the locking claws 19 are not properly locked, if the CPA member 9 is moved from the initial position to the engagement assurance position, the locking claws 19 running on the locked units 91*e* and being evacuated to the evacuation space 20 contact the cylindrical units 78 so as to prevent the movement. Thus, the female connector 3 cannot move the CPA member 9 from the initial position to the engagement assurance position when the locking claws 19 are in a semi-lock state, in other words, can detect a state of the locking claws 19 that is a semi-lock state by the fact that the CPA member 9 cannot be moved from initial position to the engagement assurance position. In this manner, the female connector 3 can move the CPA member 9 from the initial position to the engagement assurance position by the fact that the locking claws 19 are properly locked. Thus, the female connector 3 can surely implement a state where the cover member 10 is properly locked with the CPA member 9 through the locking claws 19 forming the locking units 18.

The connector according to the embodiment in the present invention is not limited to the embodiment, and various changes and modifications can be made without departing from the spirit and scope of the present invention.

The cover member 10 described as above is described as a cover member that covers the end part of the corrugated tube CT serving as an exterior member of the electric wire W2 connected to the female connector 3, but the cover member 10 is not limited to this, and, for example, may be a cover member that covers a waterproof plug and the like provided to the female connector 3.

The locking units 18 described as above are described as locking units that include the locking claws 19, but may be a locking structure in other forms, and the female connector 3 does not necessarily include the cylindrical units 78 serving as control units, the evacuation space 20, and the like.

In the above description, a connector including the CPA member 9 and the cover member 10 is the female connector 3 and the counterpart connector is the male connector 2, and vice versa.

The connector according to the embodiments can reduce an increase in size because a locking unit for locking a cover member with an engagement detection member is provided inside the outer shape line of the engagement detection member when viewed in a direction of the relative movement between a housing and the engagement detection member.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a housing that is provided with a terminal connected to a counterpart terminal of a counterpart connector and is capable of being engaged with the counterpart connector;

an engagement detection member that is assembled with the housing in a movable manner from an initial position to an engagement assurance position in a state where the counterpart connector and the housing are completely engaged with each other; and a cover member that is assembled with the engagement detection member through a locking unit locked with the engagement detection member, wherein the locking unit is provided inside an outer shape line of the engagement detection member when viewed in a direction of relative movement between the housing and the engagement detection member.

2. The connector according to claim 1, wherein the locking unit includes a locking claw that is locked with the engagement detection member and is bent when being locked with the engagement detection member, the cover member includes an evacuation space that accommodates the locking claw when the locking claw is bent, and the housing includes a control unit that is disposed outside the evacuation space in a state where the engagement detection member is disposed at the initial position and is disposed inside the evacuation space in a state where the engagement detection member is disposed at the engagement assurance position so as to control bending of the locking claw.

3. The connector according to claim 2, wherein the control unit contacts the locking claw in a state where the locking claw is bent and is evacuated to the evacuation space so as to prevent the engagement detection member from moving from the initial position to the engagement assurance position.

* * * * *